US010138535B2

(12) United States Patent
Kawamura et al.

(10) Patent No.: US 10,138,535 B2
(45) **Date of Patent: *Nov. 27, 2018**

(54) MAGNESIUM ALLOY AND METHOD OF MANUFACTURING SAME

(71) Applicant: National University Corporation Kumamoto University, Kumamoto (JP)

(72) Inventors: Yoshihito Kawamura, Kumamoto (JP); Michiaki Yamasaki, Kumamoto (JP)

(73) Assignee: NATIONAL UNIVERSITY CORPORATION KUMAMOTO UNIVERSITY, Kumamoto (JP)

( * ) Notice: Subject to any disclaimer, the term of this patent is extended or adjusted under 35 U.S.C. 154(b) by 173 days.

This patent is subject to a terminal disclaimer.

(21) Appl. No.: 15/030,229

(22) PCT Filed: Oct. 22, 2014

(86) PCT No.: PCT/JP2014/078676

§ 371 (c)(1),
(2) Date: Jul. 18, 2016

(87) PCT Pub. No.: WO2015/060459

PCT Pub. Date: Apr. 30, 2015

(65) Prior Publication Data

US 2016/0369378 A1 Dec. 22, 2016

(30) Foreign Application Priority Data

Oct. 23, 2013 (JP) ..... 2013-220562

(51) Int. Cl.
*C22F 1/06* (2006.01)
*C22C 23/02* (2006.01)
(Continued)

(52) U.S. Cl.
CPC ..... *C22C 23/02* (2013.01); *B21C 23/002* (2013.01); *B22D 21/007* (2013.01); *C22F 1/06* (2013.01)

(58) Field of Classification Search
CPC ..... C22C 23/02; C22F 1/06; B21C 23/002; B22D 21/007
See application file for complete search history.

(56) References Cited

U.S. PATENT DOCUMENTS

| | | | |
|---|---|---|---|
| 2007/0178006 | A1 | 8/2007 | Saikawa et al. |
| 2013/0209195 | A1 | 8/2013 | Kuwabara et al. |
| 2013/0213528 | A1 | 8/2013 | Hirawatari et al. |

FOREIGN PATENT DOCUMENTS

| | | |
|---|---|---|
| JP | 52-24111 | 2/1977 |
| JP | 2007-197796 | 8/2007 |

(Continued)

OTHER PUBLICATIONS

International Search Report dated Jan. 20, 2015 in International Application No. PCT/JP2014/078676.

*Primary Examiner* — C Melissa Koslow
(74) *Attorney, Agent, or Firm* — Wenderoth, Lind & Ponack, L.L.P.

(57) ABSTRACT

A magnesium alloy having high strength and high ductility and in which at least one of corrosion resistance and flame resistance is enhanced, or a method of manufacturing the same. The magnesium alloy contains an atomic % of Ca and b atomic % of Al, totally contains k atomic % of at least one element selected from a group consisting of Mn, Zr, Ag, Y and Nd, has a composition in which a remaining part is formed of Mg and contains c volume % of $(Mg, Al)_2Ca$, a, b, c and k satisfying formulae (1) to (4) and (21) below. The $(Mg, Al)_2Ca$ is dispersed and the at least one element is an element that enhances at least one of corrosion resistance
(Continued)

and flame resistance: (1) $3 \leq a \leq 7$, (2) $4.5 \leq b \leq 12$, (3) $1.2 \leq b/a \leq 3.0$, (4) $10 \leq c \leq 35$, (21) $0 < k \leq 0.3$.

36 Claims, 15 Drawing Sheets

(51) Int. Cl.
*B21C 23/00* (2006.01)
*B22D 21/00* (2006.01)

(56) References Cited

FOREIGN PATENT DOCUMENTS

| | | |
|---|---|---|
| JP | 2010-242146 | 10/2010 |
| JP | 2012-82474 | 4/2012 |
| WO | 2012/057329 | 5/2012 |
| WO | 2013/157653 | 10/2013 |

| | |
|---|---|
| ① | Mg12.33 Al58.50 Ca29.16 |
| ② | Mg15.58 Al57.60 Ca26.80 |
| ③ | Mg18.78 Al51.27 Ca29.94 |
| ④ | Mg51.44 Al21.19 Ca27.36 |
| ⑤ | Mg19.67 Al49.15 Ca31.17 |

MAGNESIUM ALLOY AND METHOD OF MANUFACTURING SAME

TECHNICAL FIELD

The present invention relates to a magnesium alloy and a method of manufacturing the same.

BACKGROUND ART

Mg—Al—Ca alloys have been mainly developed as die-cast materials. When an excessive amount of Al or Ca which is a solute element is added, a hard compound is formed to thereby give a brittle magnesium alloy, and thus it has not been possible to obtain excellent mechanical properties.

Accordingly, although magnesium alloys having low addition amounts of Al and Ca have been developed, the strength thereof has not been improved. Under the above circumstances, with respect to the researches on Mg—Al—Ca alloys, researches on phases to be formed and researches on only Mg—Al—Ca alloys having extremely low addition amounts of Al and Ca are often performed.

Furthermore, in order to make magnesium alloys commercially available, it is necessary to enhance flame resistance and to increase the ignition temperature thereof. However, when the flame resistance is enhanced, the mechanical properties are often lowered, and the flame resistance and the mechanical properties are in the relation of trade-off, with the result that it is difficult to enhance both of them.

Moreover, in order to make magnesium alloys commercially available, the enhancement of corrosion resistance is also required.

DISCLOSURE OF THE INVENTION

Problem to be Solved

In an aspect of the present invention, an object thereof is to provide a magnesium alloy which has high flame resistance, high strength and high ductility or a method of manufacturing the same.

Furthermore, in another aspect of the present invention, an object thereof is to provide a magnesium alloy which has high strength and high ductility and in which at least one of corrosion resistance and flame resistance is enhanced, or a method of manufacturing the same.

Solutions to the Problems

Hereinafter, various aspects of the present invention will be described.

[1] A magnesium alloy that contains a atomic % of Ca and b atomic % of Al, totally contains k atomic % of at least one element selected from a group consisting of Mn, Zr, Ag, Y and Nd, contains a residue of Mg and contains c volume % of $(Mg, Al)_2Ca$, a, b, c and k satisfying formulae (1) to (4) and (21) below, wherein the $(Mg, Al)_2Ca$ is dispersed and the at least one element is an element that enhances at least one of corrosion resistance and flame resistance:

$$3 \le a \le 7 \quad (1)$$

$$4.5 \le b \le 12 \quad (2)$$

$$1.2 \le b/a \le 3.0 \quad (3)$$

$$10 \le c \le 35 \text{ (preferably, } 10 \le c \le 30) \quad (4)$$

$$0 < k \le 0.3. \quad (21)$$

[2] A magnesium alloy that contains a atomic % of Ca and b atomic % of Al, totally contains k atomic % of at least one element selected from a group consisting of Mn, Zr, Ag, Y and Nd, contains a residue of Mg and contains c volume % of $(Mg, Al)_2Ca$, a, b, c and k satisfying formulae (1) to (4) and (21) below, wherein the $(Mg, Al)_2Ca$ is dispersed and the at least one element is an element that enhances at least one of corrosion resistance and flame resistance:

$$3 \le a \le 7 \quad (1)$$

$$8 \le b \le 12 \quad (2)$$

$$1.2 \le b/a \le 3.0 \quad (3)$$

$$10 \le c \le 35 \text{ (preferably, } 10 \le c \le 30) \quad (4)$$

$$0 < k \le 0.3. \quad (21)$$

[3] The magnesium alloy according to [1] or [2] above, wherein x atomic % of Zn is contained in the magnesium alloy, x satisfying formula (20) below:

$$0 < x \le 3 \text{ (preferably, } 1 \le x \le 3). \quad (20)$$

[4] The magnesium alloy according to any one of [1] to [3] above, wherein the magnesium alloy contains d volume % of $Al_{12}Mg_{17}$, d satisfying formula (5) below:

$$0 < d \le 10. \quad (5)$$

[5] The magnesium alloy according to any one of [1] to [4] above, wherein a crystal grain diameter of the $(Mg, Al)_2Ca$ dispersed is e, e satisfying formula (6) below:

$$1 \text{ nm} \le e \le 2 \text{ μm}. \quad (6)$$

[6] The magnesium alloy according to any one of [1] to [5] above, wherein a volume fraction of a region where the $(Mg, Al)_2Ca$ is dispersed is f %, f satisfying formula (7) below:

$$35 \le f \le 65. \quad (7)$$

[7] The magnesium alloy according to any one of [1] to [6] above, wherein an ignition temperature of the magnesium alloy is equal to or more than 850° C.

[8] The magnesium alloy according to any one of [1] to [7] above, wherein the a and b satisfy formulae (1') and (2') below:

$$4 \le a \le 6.5 \quad (1')$$

$$7.5 \le b \le 11. \quad (2')$$

[9] The magnesium alloy according to [8] above, wherein the a and b satisfy formula (3') below:

$$11/7 \le b/a \le 12/5. \quad (3')$$

[10] The magnesium alloy according to [8] or [9] above, wherein the ignition temperature of the magnesium alloy is equal to or more than 1090° C.

[11] The magnesium alloy according to any one of [1] to [10] above, wherein when in the magnesium alloy, compression yield strength is g and tensile yield strength is h, g and h satisfy formula (8) below:

$$0.8 \leq g/h. \quad (8)$$

[12] The magnesium alloy according to any one of [1] to [11] above, wherein i atomic % of at least one element selected from a group consisting of rare earth elements other than Y and Nd, Si, Sc, Sn, Cu, Li, Be, Mo, Nb and W is contained in the magnesium alloy, i satisfying formula (9) below:

$$0 < i \leq 0.3. \quad (9)$$

[13] The magnesium alloy according to any one of [1] to [12] above, wherein j atomic % of at least one compound selected from a group consisting of $Al_2O_3$, $Mg_2Si$, SiC, MgO and CaO is contained in the magnesium alloy, as an amount of metal atoms in the compound, j satisfying formula (10) below:

$$0 < j \leq 5. \quad (10)$$

[14] A method of manufacturing a magnesium alloy, the method including the steps of:

forming, by a casting method, a cast that contains a atomic % of Ca and b atomic % of Al, totally contains k atomic % of at least one element selected from a group consisting of Mn, Zn, Zr, Ag, Y and Nd, has a composition in which a remaining part is formed of Mg, and contains c volume % of $(Mg, Al)_2Ca$, a, b and c satisfying formulae (1) to (4) and (21) below, and performing plastic processing on the cast, wherein the at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 35 \text{ (preferably, } 10 \leq c \leq 30) \quad (4)$$

$$0 < k \leq 0.3. \quad (21)$$

[15] A method of manufacturing a magnesium alloy, the method including the steps of:

forming, by a casting method, a cast that contains a atomic % of Ca and b atomic % of Al, totally contains k atomic % of at least one element selected from a group consisting of Mn, Zn, Zr, Ag, Y and Nd, contains a residue of Mg and contains c volume % of $(Mg, Al)_2Ca$, a, b and c satisfying formulae (1) to (4) and (21) below, and performing plastic processing on the cast, wherein the at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 30 \quad (4)$$

$$0 < k \leq 0.3. \quad (21)$$

[16] A method of manufacturing a magnesium alloy, the method including the steps of:

forming, by a casting method, a cast that contains a atomic % of Ca and b atomic % of Al, totally contains k atomic % of at least one element selected from a group consisting of Mn, Zr, Ag, Y and Nd, contains x atomic % of Zn, and contains a residue of Mg, a, b and c satisfying formulae (1) to (3), (20) and (21) below, and performing plastic processing on the cast, wherein the at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$0 < x \leq 3 \quad (20)$$

$$0 < k \leq 0.3. \quad (21)$$

[17] The method of manufacturing a magnesium alloy according to [16] above, wherein the cast contains c volume % of $(Mg, Al)_2Ca$ and c satisfies formula (4) below:

$$10 \leq c \leq 35. \quad (4)$$

[18] A method of manufacturing a magnesium alloy, the method including the steps of:

forming, by a casting method, a cast that contains a atomic % of Ca and b atomic % of Al, contains a residue of Mg, and contains c volume % of $(Mg, Al)_2Ca$, a, b, c satisfying formulae (1) to (4) below, and performing heat treatment on the cast at a temperature of 723 to 773K for 0.5 hours or more, and performing plastic processing on the cast, $$3 \leq a \leq 7 \quad (1)$$

$$4.5 \leq b \leq 12 \quad (2)$$

$$1.2 \leq b/a \leq 3.0 \quad (3)$$

$$10 \leq c \leq 35 \quad (4)$$

[19] The method of manufacturing a magnesium alloy according to any one of [14] to [18] above, wherein the cast contains d volume % of $Al_{12}Mg_{17}$, d satisfying formula (5) below:

$$0 < d \leq 10. \quad (5)$$

[20] The method of manufacturing a magnesium alloy according to any one of [14] to [19] above, wherein a cooling rate when the cast is formed is equal to or less than 1000K/second.

[21] The method of manufacturing a magnesium alloy according to any one of [14] to [20] above, wherein an equivalent strain when the plastic processing is performed is equal to or more than 2.2.

[22] The method of manufacturing a magnesium alloy according to any one of [14] to [21], wherein before the plastic processing, heat treatment is performed on the cast at a temperature of 400 to 600° C. for 5 minutes to 24 hours.

[23] The method of manufacturing a magnesium alloy according to any one of [14] to [17] above, wherein before the plastic processing, heat treatment is performed on the cast at a temperature of 723 to 773K for 0.5 hours or more.

[24] The method of manufacturing a magnesium alloy according to any one of [14] to [23] above, wherein the a and b satisfy formulae (1') and (2') below:

$$4 \leq a \leq 6.5 \quad (1')$$

$$7.5 \leq b \leq 11. \quad (2')$$

[25] The method of manufacturing a magnesium alloy according to [24] above, wherein the a and b satisfy formula (3') below:

$$11/7 \leq b/a \leq 12/5. \quad (3')$$

[26] The method of manufacturing a magnesium alloy according to any one of [14] to [25] above, wherein a crystal grain diameter of the $(Mg, Al)_2Ca$ after the plastic processing is e, e satisfying formula (6) below:

$$1\ \text{nm} \leq e \leq 2\ \mu\text{m}. \quad (6)$$

[27] The method of manufacturing a magnesium alloy according to any one of [14] to [26] above, wherein a volume fraction of a region where the $(Mg, Al)_2Ca$ is dispersed after the plastic processing is f %, f satisfying formula (7) below:

$$35 \leq f \leq 65. \quad (7)$$

[28] The method of manufacturing a magnesium alloy according to any one of [14] to [27] above, wherein after the plastic processing, heat treatment is performed on the magnesium alloy.

[29] The method of manufacturing a magnesium alloy according to any one of [14] to [27] above, wherein after the plastic processing, solution treatment is performed on the magnesium alloy.

[30] The method of manufacturing a magnesium alloy according to [29] above, wherein after the solution treatment, aging treatment is performed on the magnesium alloy.

[31] The method of manufacturing a magnesium alloy according to any one of [14] to [30] above, wherein when in the magnesium alloy, compression yield strength is g and tensile yield strength is h, g and h satisfy formula (8) below:

$$0.8 \leq g/h. \quad (8)$$

[32] The method of manufacturing a magnesium alloy according to any one of [14] to [31] above, wherein i atomic % of at least one element selected from a group consisting of rare earth elements other than Y and Nd, Si, Sc, Sn, Cu, Li, Be, Mo, Nb and W is contained in the cast, i satisfying formula (9) below:

$$0 < i \leq 0.3. \quad (9)$$

[33] The method of manufacturing a magnesium alloy according to any one of [14] to [32] above, wherein j atomic % of at least one compound selected from a group consisting of $Al_2O_3$, $Mg_2Si$, SiC, MgO and CaO is contained in the cast as an amount of metal atoms in the compound, j satisfying formula (10) below:

$$0 < j \leq 5. \quad (10)$$

Effect of the Invention

An aspect of the present invention is applied, and thus it is possible to provide a magnesium alloy which has high flame resistance, high strength and high ductility or to provide a method of manufacturing the same.

Another aspect of the present invention is applied, and thus it is possible to provide a magnesium alloy which has high strength and high ductility and in which at least one of corrosion resistance and flame resistance is enhanced or to provide a method of manufacturing the same.

DESCRIPTION OF THE PREFERRED EMBODIMENTS

Figure 1:
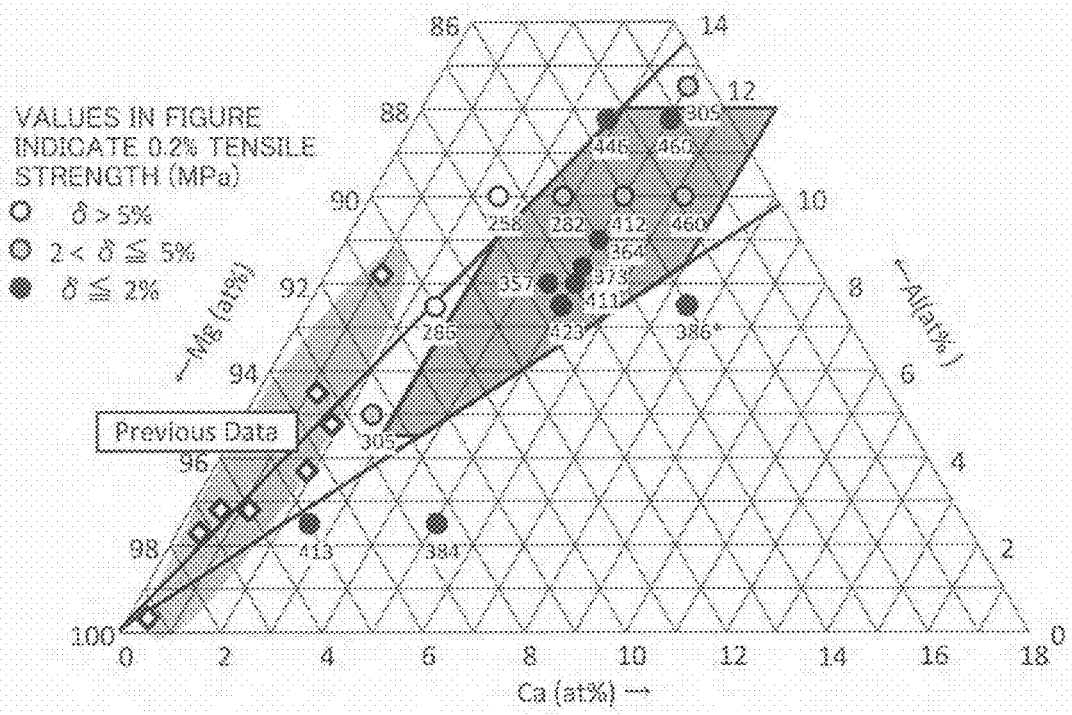
FIG. 1 is a diagram illustrating results when a tensile test was performed on $Mg_{100-a-b}Ca_aAl_b$ alloy cast extruded materials at room temperature.

Hereinafter, embodiments of the present invention will be explained in detail using the drawings. However, a person skilled in the art would be able to easily understand that the present invention is not limited to the following explanation but the form and details thereof can be changed variously without deviating from the gist and the scope of the present invention. Accordingly, the present invention should not be construed as being limited to the description of the present embodiments shown below.

First Embodiment

In an aspect of the present invention, an expanded material having high strength is developed by using an Mg—Al—Ca alloy that is a magnesium alloy obtained by adding a high concentration of solute element. The tensile yield strength and the elongation of an extruded material of $Mg_{83.75}Al_{10}Ca_{6.25}$ according to the aspect of the present invention exhibiting excellent mechanical properties reach 460 MPa and 3.3%, respectively, and significantly exceed the properties of conventional Mg—Al—Ca alloy cast material and expanded material.

The conventional researches report that, when in the Mg—Al—Ca alloy, the volume fraction of a compound containing Al and Ca is increased, the ductility is lowered, and thus brittleness is exhibited.

However, the present inventors have found that, in order to develop an expanded material in a high concentration composition range of Al and Ca in which the volume fraction of a compound is high, a hard Mg—Al—Ca ternary compound, for example, $(Mg, Al)_2Ca$ which is a C36-type compound is dispersed in a metal structure, and thus high strength and relatively high ductility can be obtained.

Advantages of the addition of Al to Mg are the enhancement of the mechanical properties, the enhancement of the corrosion resistance, and the contribution to the weight reduction because the specific gravity of Al is 2.70.

Advantages of the addition of Ca to Mg are the enhancement of the flame resistance, the enhancement of the mechanical properties, the enhancement of the creep resistance, and the contribution to the weight reduction because the specific gravity of Ca is 1.55.

The magnesium alloy according to one aspect of the present invention contains a atomic % of Ca and b atomic % of Al, has a composition in which the remaining part is formed of Mg, and contains c volume % of $(Mg, Al)_2Ca$ which is a C36 type compound, a, b and c satisfying formulae (1) to (4) below, and $(Mg, Al)_2Ca$ is dispersed. Note that, more preferably, a and b satisfy formulae (1') and (2') below, and further preferably, a and b satisfy formula (3') below.

$$3 \le a \le 7 \quad (1)$$

$$4.5 \le b \le 12 (\text{or } 8 \le b \le 12) \quad (2)$$

$$1.2 \le b/a \le 3.0 \quad (3)$$

$$10 \le c \le 35 \text{ (preferably, } 10 \le c \le 30) \quad (4)$$

$$4 \le a \le 6.5 \quad (1')$$

$$7.5 \le b \le 11 \quad (2')$$

$$11/7 \le b/a \le 12/5 \quad (3')$$

The reasons why the contents of Al and Ca are set within the ranges of formulae (1) and (2) above are as follows.

When the content of Al exceeds 12 atomic %, it is not possible to obtain sufficient strength.

When the content of Al is less than 4.5 atomic %, it is not possible to obtain sufficient ductility.

When the content of Ca exceeds 7 atomic %, it becomes difficult to bring the magnesium alloy into a solidified state, and thus it is difficult to perform plastic processing.

When the content of Ca is less than 3 atomic %, it is not possible to obtain sufficient flame resistance.

Although, in the magnesium alloy described above, the component other than Al and Ca whose contents fall within the ranges described above is magnesium, impurities and other elements may be contained to the extent of not affecting the properties of the alloy. In other words, the above statement "the remaining part is formed of Mg" means not only that the entire remaining part is formed of Mg but also that the remaining part contains impurities and other elements to the extent of not affecting the properties of the alloy.

Since $(Mg, Al)_2Ca$ described above is a hard compound, it is possible to obtain high strength by finely dispersing the hard compound. In other words, in order to obtain high strength, it is preferable to disperse, in a metal structure, a high volume fraction of $(Mg, Al)_2Ca$ which is a hard compound. Note that the degree of the dispersion of $(Mg, Al)_2Ca$ is preferably equal to or more than one piece/$\mu m_2$.

Furthermore, $(Mg, Al)_2Ca$ is an equiaxed crystal, and preferably, the aspect ratio of the crystal grain of $(Mg, Al)_2Ca$ is approximately 1.

Moreover, the magnesium alloy described above contains d volume % of $Al_{12}Mg_{17}$ (β phase), and d preferably satisfies formula (5) below. The β phase is not always a necessary phase but is inevitably generated depending on the composition.

$$0 < d \le 10 \quad (5)$$

In addition, the crystal grain diameter of $(Mg, Al)_2Ca$ dispersed as described above is e, and e preferably satisfies formula (6) below.

$$1 \text{ nm} \le e \le 2 \ \mu\text{m} \quad (6)$$

The crystal grain diameter of $(Mg, Al)_2Ca$ is set equal to or less than 2 μm, and thus it is possible to obtain the magnesium alloy having high strength.

However, formula (6) above does not mean that all of $(Mg, Al)_2Ca$ in the magnesium alloy cannot increase strength if they do not have a crystal grain diameter of 2 μm or less, but means that the magnesium alloy having high strength can be obtained if main $(Mg, Al)_2Ca$ may have a crystal grain diameter of 2 μm or less, namely, if, for example, 50 volume % or more of $(Mg, Al)_2Ca$ in the magnesium alloy has a crystal grain diameter of 2 μm or less. Note that the reason why main $(Mg, Al)_2Ca$ may have a crystal grain diameter of 2 μm or less is because $(Mg, Al)_2Ca$ whose crystal grain diameter is more than 2 μm is likely to be present in the magnesium alloy.

As described above, the volume fraction of a region where $(Mg, Al)_2Ca$ is dispersed is f %, f preferably satisfies formula (7) below, and f more preferably satisfies formula (7') below.

$$35 \leq f \leq 65 \quad (7)$$

$$35 \leq f \leq 55 \quad (7')$$

In the magnesium alloy, a compound-free region where the C36 type compound is not dispersed and a compound dispersed region where the C36 type compound is dispersed are present. The compound dispersed region means the above region where $(Mg, Al)_2Ca$ is dispersed.

The compound dispersed region contributes to the enhancement of the strength, and the compound-free region contributes to the enhancement of the ductility. Therefore, as the compound dispersed region is larger, the strength can be increased, whereas as the compound-free region is larger, the ductility can be increased. Accordingly, the volume fraction f of the region where $(Mg, Al)_2Ca$ is dispersed in the magnesium alloy satisfies formula (7) or formula (7') above, and thus it is possible to enhance the ductility while maintaining the high strength.

As described above, 3 atomic % or more of Ca is contained in Mg, and thus the ignition temperature of the magnesium alloy can be 900° C. or more.

Furthermore, as described above, 4 atomic % or more of Ca is contained in Mg, and thus the ignition temperature of the magnesium alloy can be 1090° C. or more (the boiling point or more). When as described above, the ignition temperature is the boiling point of the magnesium alloy or more, it can be said that the magnesium alloy is a substantially incombustible magnesium alloy.

Moreover, in the magnesium alloy described above, when it is assumed that its compression yield strength is g and its tensile yield strength is h, g and h satisfy formula (8) below.

$$0.8 \leq g/h \quad (8)$$

Since the ratio of the compression yield strength to the tensile yield strength of a conventional magnesium alloy is equal to or less than 0.7, it can be said that the magnesium alloy according to the present embodiment has high strength in this respect.

Preferably, in the magnesium alloy described above, i atomic % of at least one element selected from a group consisting of Mn, Zr, Si, Sc, Sn, Ag, Cu, Li, Be, Mo, Nb, W and rare earth elements is contained, and i satisfies formula (9) below. Accordingly, it is possible to improve various properties (for example, corrosion resistance) while having high flame resistance, high strength and high ductility.

$$0 < i \leq 0.3 \quad (9)$$

In the magnesium alloy described above, j atomic % of at least one compound selected from a group consisting of $Al_2O_3$, $Mg_2Si$, SiC, MgO and CaO is contained as the amount of metal atoms in the compound, j preferably satisfies formula (10) below and j more preferably satisfies formula (10') below. In this way, it is possible to improve various properties while having high flame resistance, high strength and high ductility.

$$0 < j \leq 5 \quad (10)$$

$$0 < j \leq 2 \quad (10')$$

In the present embodiment, the Mg—Al—Ca ternary compound which is a hard compound is dispersed in the metal structure, and thus it is possible to enhance the mechanical properties, to obtain high strength and relatively high ductility and to enhance the flame resistance.

Furthermore, preferably, in the magnesium alloy described above, x atomic % of Zn is contained, and x satisfies formula (20) below.

$$0 < x \leq 3 \text{ (preferably, } 1 \leq x \leq 3\text{, and more preferably, } 1 \leq x \leq 2) \quad (20)$$

As described above, Zn is contained, and thus it is possible to enhance the strength and the ignition temperature.

Second Embodiment

In an aspect of the present invention, a fourth element is added to an Mg—Al—Ca alloy that is a magnesium alloy obtained by adding a high concentration of solute element, and thus at least one of the corrosion resistance and the flame resistance is enhanced. The fourth element is Mn, Zn, Zr, Ag, Y or Nd.

The magnesium alloy according to the aspect of the present invention contains a atomic % of Ca and b atomic % of Al, totally contains k atomic % of at least one element selected from a group consisting of Mn, Zr, Ag, Y and Nd, has a composition in which a remaining part is formed of Mg and contains c volume % of $(Mg, Al)_2Ca$ which is the C36 type compound, a, b, c and k satisfying formulae (1) to (4) and (21) below, wherein the $(Mg, Al)_2Ca$ is dispersed and the at least one element is an element that enhances at least one of corrosion resistance and flame resistance. More preferably, a and b satisfy formulae (1') and (2') below, and further preferably, a and b satisfy formula (3') below.

$$3 \leq a \leq 7 \quad (1)$$

$$4.5 \leq b \leq 12 \text{(or } 8 \leq b \leq 12) \quad (2)$$

$$1.2 \leq b/a \leq 3.0 \quad (3)$$

$$10 \leq c \leq 35 \text{ (preferably, } 10 \leq c \leq 30) \quad (4)$$

$$0 < k \leq 0.3. \quad (21)$$

$$4 \leq a \leq 6.5 \quad (1')$$

$$7.5 \leq b \leq 11 \quad (2')$$

$$11/7 \leq b/a \leq 12/5 \quad (3')$$

The reasons why the contents of Al and Ca are set within the ranges of formulae (1) and (2) above are the same as in the first embodiment.

Although in the magnesium alloy described above, the component other than Al and Ca whose contents fall within the ranges described above and the at least one element is magnesium, impurities and other elements may be contained to the extent of not affecting the properties of the alloy. In other words, the above statement "the remaining part is formed of Mg" means not only that the entire remaining part is formed of Mg but also that the remaining part contains impurities and other elements to the extent of not affecting the properties of the alloy.

The reasons why $(Mg, Al)_2Ca$ described above is contained are also the same as in the first embodiment. $(Mg, Al)_2Ca$ is an equiaxed crystal. In addition, the aspect ratio of the crystal grain of $(Mg, Al)_2Ca$. Furthermore, the content of $Al_{12}Mg_{17}$ (β phase), the crystal grain diameter of $(Mg, Al)_2Ca$ and the volume fraction of a region where $(Mg, Al)_2Ca$ is dispersed are the same as in the first embodiment.

In the magnesium alloy, the compound-free region and the compound dispersed region are present as in the first embodiment.

3 atomic % or more of Ca is contained in Mg, and thus the ignition temperature of the magnesium alloy can be 900° C. or more as in the first embodiment, and thus the ignition temperature can be further increased by the addition of at least one element of Mn, Zr, Ag, Y and Nd.

In addition, as described above, 4 atomic % or more of Ca is contained in Mg, and thus the ignition temperature of the magnesium alloy can be 1090° C. or more (the boiling point or more) as in the first embodiment.

Additionally, it is possible to enhance corrosion resistance by the addition of at least one element of Mn and Zn to Mg.

Furthermore, in the magnesium alloy described above, when it is assumed that the compression yield strength is g and the tensile yield strength is h, the relationship between g and h is the same as in the first embodiment.

Moreover, preferably, in the magnesium alloy described above, i atomic % of at least one element selected from a group consisting of rare earth elements other than Y and Nd, Si, Sc, Sn, Cu, Li, Be, Mo, Nb and W is contained, and i satisfies formula (9) below. Accordingly, it is possible to improve various properties while simultaneously having high flame resistance, high strength and high ductility.

$$0<i\leq 0.3 \quad (9)$$

In addition, the amount of metal atoms in at least one compound selected from a group consisting of $Al_2O_3$, $Mg_2Si$, SiC, MgO and CaO contained in the magnesium alloy described above is the same as in the first embodiment.

Also in the present embodiment, the same effects as in the first embodiment can also be obtained.

Additionally, in the present embodiment, as the fourth element, it is possible to enhance at least one of the corrosion resistance and the flame resistance by the addition of at least one element of Mn, Zn, Zr, Ag, Y and Nd to the Mg—Al—Ca alloy. Specifically, by the addition of at least one element of Mn, Zn, Zr, Ag, Y and Nd to the Mg—Al—Ca alloy as the fourth element, it is possible to increase the ignition temperature as compared with the Mg—Al—Ca alloy without addition of the fourth element. Furthermore, by the addition of at least one element of Mn and Zn to the Mg—Al—Ca alloy as the fourth element, it is possible to increase the corrosion resistance as compared with the Mg—Al—Ca alloy without addition of the fourth element.

Third Embodiment

A method of manufacturing a magnesium alloy according to an aspect of the present invention will be described.

A cast is first produced from a magnesium alloy by melting and casting. The composition of the magnesium alloy is the same as in the first embodiment or the second embodiment. As in the first embodiment or the second embodiment, the cast includes an Mg—Al—Ca ternary compound and may include $Al_{12}Mg_{17}$.

Note that a cooling rate at the time of casting by melting and casting is equal to or less than 1000 K/second, and is more preferably equal to or less than 100 K/second.

Then, plastic processing is performed on the cast including the Mg—Al—Ca ternary compound which is a hard compound, and thus the Mg—Al—Ca ternary compound can be finely dispersed, with the result that the magnesium alloy can obtain high strength and relatively high ductility and can enhance the flame resistance. Note that an equivalent strain when the plastic processing is performed is preferably equal to or more than 2.2 (corresponding to an extrusion ratio of 9 or more).

The above method of performing the plastic processing includes, for example, extrusion, an ECAE (equal-channel-angular-extrusion) processing method, rolling, drawing and forging, repeated processing thereof and FSW processing, all of which can be used.

Preferably, in the case where the plastic processing is performed by extrusion, the temperature of extrusion is set equal to or more than 250° C. and equal to or less than 500° C., and a cross-section reduction rate by extrusion is set equal to or more than 5%.

The ECAE processing method is a method of rotating a sample in a longitudinal direction by 90° per pass in order to introduce a uniform strain into the sample. Specifically, in this method, a magnesium alloy cast serving as a molding material is forcibly made to enter a molding hole in a molding die with the molding hole having a cross section formed in the shape of the letter L, and in particular, at a part where the L-shaped molding hole is bent by 90°, a stress is applied to the magnesium alloy cast, with the result that a molded body having excellent strength and toughness can be obtained. The number of passes in the ECAE is preferably 1 to 8, and is more preferably 3 to 5. The temperature at the time of the ECAE processing is preferably equal to or more than 250° C. and equal to or less than 500° C.

Preferably, in the case where plastic processing is performed by ductility, the temperature of ductility is set equal to or more than 250° C. and equal to or less than 500° C., and the rolling reduction is set equal to or more than 5%.

Preferably, in the case where plastic processing is performed by drawing processing, the temperature when the drawing processing is performed is set equal to or more than 250° C. and equal to or less than 500° C., and the cross-section reduction rate of the drawing processing is set equal to or more than 5%.

Preferably, in the case where plastic processing is performed by forging, the temperature when the forging is performed is set equal to or more than 250° C. and equal to or less than 500° C., and the processing rate of the forging processing is set equal to or more than 5%.

Since as described above, in the plastic processing product obtained by performing the plastic processing on the magnesium alloy, the hard compound is finely dispersed, as compared with that before the plastic processing is performed, it is possible to extremely enhance mechanical properties such as strength and ductility.

Before the above plastic processing is performed, heat treatment may be performed on the cast at a temperature of 400 to 600° C. for 5 minutes to 24 hours. It is possible to enhance the ductility by this heat treatment.

Before the above plastic processing is performed, heat treatment is performed on the cast at a temperature of 723 to 773K for 0.5 hours or more, and thus it is possible to further enhance the ductility while holding a high tensile yield strength (YS) of 0.2%.

The crystal grain diameter of $(Mg, Al)_2Ca$ in the magnesium alloy after the above plastic processing is performed is e, and e preferably satisfies formula (6) below. As described above, the crystal grain diameter is set equal to or less than 2 μm, and thus it is possible to obtain a magnesium alloy having high strength:

$$1\ \text{nm} \leq e \leq 2\ \mu\text{m}. \quad (6)$$

The volume fraction of a region where $(Mg, Al)_2Ca$ is dispersed in the magnesium alloy after the above plastic processing is performed is f %, f preferably satisfies formula (7) below, and f more preferably satisfies formula (7') below:

$$35 \leq f \leq 65 \quad (7)$$

$$35 \leq f \leq 55. \quad (7')$$

As described above, the volume fraction f of the region where $(Mg, Al)_2Ca$ is dispersed in the magnesium alloy satisfies formula (7) or (7') above, and thus it is possible to enhance the ductility while maintaining high strength.

In addition, in the magnesium alloy after the above plastic processing is performed, when it is assumed that its compression yield strength is g and its tensile yield strength is h, g and h preferably satisfy formula (8) below:

$$0.8 \leq g/h. \quad (8)$$

Furthermore, after the above plastic processing is performed, heat treatment is preferably performed on the magnesium alloy at a temperature of 175 to 350° C. for 30 minutes to 150 hours. Accordingly, precipitation strengthening occurs, and thus its hardness value is increased.

Moreover, after the above plastic processing is performed, solution treatment is preferably performed on the magnesium alloy at a temperature of 350 to 560° C. for 30 minutes to 12 hours. Thereby, the solid solution of a solute element in a mother phase which is necessary for the formation of a precipitate is facilitated.

In addition, after the above solution treatment is performed, aging treatment is preferably performed on the magnesium alloy at a temperature of 175 to 350° C. for 30 minutes to 150 hours. Accordingly, precipitation strengthening occurs, and thus its hardness value is increased.

Fourth Embodiment

A magnesium alloy according to the present embodiment is obtained as follows. In the same method as in the third embodiment, a magnesium alloy material including an Mg—Al—Ca ternary compound is prepared, a plurality of chip-shaped cut materials of a few mm or less square made by cutting the magnesium alloy material is produced, and the cut materials are solidified such that shearing is added thereto. As the solidification method, there may be adopted a method of, for example, packing the cut materials into a can, pushing them by using a bar-shaped member having the same shape as the inner shape of the can, and thereby solidifying the cut materials by the addition of shearing thereto.

In the present embodiment, the same effects as in the third embodiment can also be obtained.

The magnesium alloy in which the chip-shaped cut materials are solidified can have higher strength and higher ductility than a magnesium alloy in which cutting and solidification are not performed. In addition, plastic processing may be performed on the magnesium alloy obtained by solidifying the cut materials.

Note that the magnesium alloys according to the above first to third embodiments can be used in components used in a high-temperature atmosphere such as an aircraft component and an automotive component, in particular, in a combustion engine piston, a valve, a lifter, a tappet, a sprocket light and the like.

Example 1

(Production of samples)

First, ingots (cast materials) such as $Mg_{100-a-b}Ca_aAl_b$ alloys (a: 2.5 to 7.5 at. %, b: 2.5 to 12.5 at. %) of compositions shown in Table 1 were produced by high-frequency induction melting in an atmosphere of Ar gas, and extrusion billets cut from these ingots into a shape of ϕ 29×65 mm were prepared. Then, extrusion processing was performed on the extrusion billets under conditions shown in Table 1. The extrusion processing was performed at an extrusion ratio of 5, 7.5 and 10, at an extrusion temperature of 523K, 573K and 623K, and at an extrusion rate of 2.5 mm/second.

(Mechanical Properties of Cast Extruded Material)

A tensile test and a compression test were performed, materials and the like obtained by performing the above extrusion processing. The results thereof are illustrated in Table 1 and FIGS. 1 and 2. Note that, in FIGS. 1 and 2, "*" represents an elastic range break. In the tensile property of Table 1, YS indicates 0.2% tensile yield strength and UTS indicates tensile strength, and in the compression property of Table 1, YS indicates 0.2% compression yield strength and UTS indicates compression strength.

TABLE 1

| | Extrusion conditions | | Mechanical properties | | | | | |
|---|---|---|---|---|---|---|---|---|
| | | | Tensile property | | | Compression property | | |
| Alloy composition (at %) | Extrusion temperature (K) | Extrusion ratio Equivalent strain in parentheses | YS (MPa) | UTS (MPa) | Elongation (%) | YS (MPa) | UTS (MPa) | Elongation (%) |
| Mg87.5—Al10—Ca2.5 | 523 | 10 (2.3) | 258 | 350 | 7.8 | | | |
| Mg86.25—Al10—Ca3.75 | 523 | 10 (2.3) | 282 | 342 | 2.8 | | | |
| Mg85—Al10—Ca5 | 523 | 10 (2.3) | 412 | 459 | 3.3 | 395 | Interrupted halfway | >10 (Interrupted halfway) |
| | | 7.5 (2.01) | 338 | 379 | 1.24 | | | |
| | | 5 (1.61) | 348 | 425 | 1.72 | | | |
| Mg83.75—Al10—Ca6.25 | 523 | 10 (2.3) | 460 | 495 | 3.3 | 441 | 562 | 5.6 |

TABLE 1-continued

| Alloy composition (at %) | Extrusion conditions: Extrusion temperature (K) | Extrusion conditions: Extrusion ratio Equivalent strain in parentheses | Mechanical properties: Tensile property: YS (MPa) | Tensile property: UTS (MPa) | Tensile property: Elongation (%) | Compression property: YS (MPa) | Compression property: UTS (MPa) | Compression property: Elongation (%) |
|---|---|---|---|---|---|---|---|---|
| Mg82.5—Al10—Ca7.5 | 523 | 10 (2.3) | Elastic range brake | 430 | Elastic range brake | | | |
| Mg95—Al2.5—Ca2.5 | 523 | 10 (2.3) | 413 | 487 | 1.8 | | | |
| Mg92.5—Al5—Ca2.5 | 523 | 10 (2.3) | 305 | 437 | 3.5 | | | |
| Mg90—Al7.5—Ca2.5 | 523 | 10 (2.3) | 286 | 364 | 5.8 | | | |
| Mg87.5—Al7.5—Ca5 | 523 | 10 (2.3) | 423 | 447 | 1.2 | | | |
| Mg83.75—Al11.25—Ca5 | 523 | 10 (2.3) | 460 | 395 | 1.38 | | | |
| Mg82.5—Al12.5—Ca5 | 523 | 10 (2.3) | 305 | 377 | 5.6 | | | |
| Mg85—Al8.75—Ca6.25 | 523 | 10 (2.3) | Elastic range brake | 415 | Elastic range brake | | | |
| Mg87.5—Ca4.5—Al8 | 523 | 10 (2.3) | 357 | 431 | 1.8 | | | |
| Mg87—Ca5—Al8 | 523 | 10 (2.3) | 411 | 487 | 1.6 | | | |
| Mg86.75—Ca5—Al8.25 | 523 | 10 (2.3) | 373 | 415 | 0.9 | | | |
| Mg86—Ca5—Al9 | 523 | 10 (2.3) | 364 | 418 | 1 | | | |
| Mg84—Ca8—Al8 | 523 | 10 (2.3) | | | Incapable of extrusion | | | |
| | 573 | 10 (2.3) | | | Incapable of extrusion | | | |
| Mg83.85—Ca8—Al8—Mn0.15 | 523 | 10 (2.3) | | | Incapable of extrusion | | | |
| | 573 | 10 (2.3) | | | Incapable of extrusion | | | |
| | 623 | 10 (2.3) | | | Incapable of extrusion | | | |
| Mg85—Al8—Ca7 | 523 | 10 (2.3) | | | Incapable of extrusion | | | |
| | 573 | 10 (2.3) | Elastic range brake | — | Elastic range brake | | | |
| Mg85—Al7.5—Ca7.5 | 523 | 10 (2.3) | | | Incapable of extrusion | | | |
| | 573 | 10 (2.3) | Elastic range brake | — | Elastic range brake | | | |
| Mg77.5—Al15—Ca7.5 | 523 | 10 (2.3) | | | Incapable of extrusion | | | |
| | 573 | 10 (2.3) | 387 | 426 | 0.77 | | | |

A first composition range that is surrounded by thick lines illustrated in FIG. 1 and that is hatched indicates a magnesium alloy which contains a atomic % of Ca and b atomic % of Al, in which the remaining part is formed of Mg, a and b satisfying formulae (1) to (3) below.

$$3 \leq a \leq 7 \quad (1)$$

$$4.5 \leq b \leq 12 \quad (2)$$

$$1.2 \leq b/a \leq 3.0 \quad (3)$$

A second composition range that is surrounded by thick lines illustrated in FIG. 2 and that is hatched indicates a magnesium alloy, the a and the b above satisfying formulae (1') to (3') below.

$$4 \leq a \leq 6.5 \quad (1')$$

$$7.5 \leq b \leq 11 \quad (2')$$

$$11/7 \leq b/a \leq 12/5 \quad (3')$$

Figure 2:
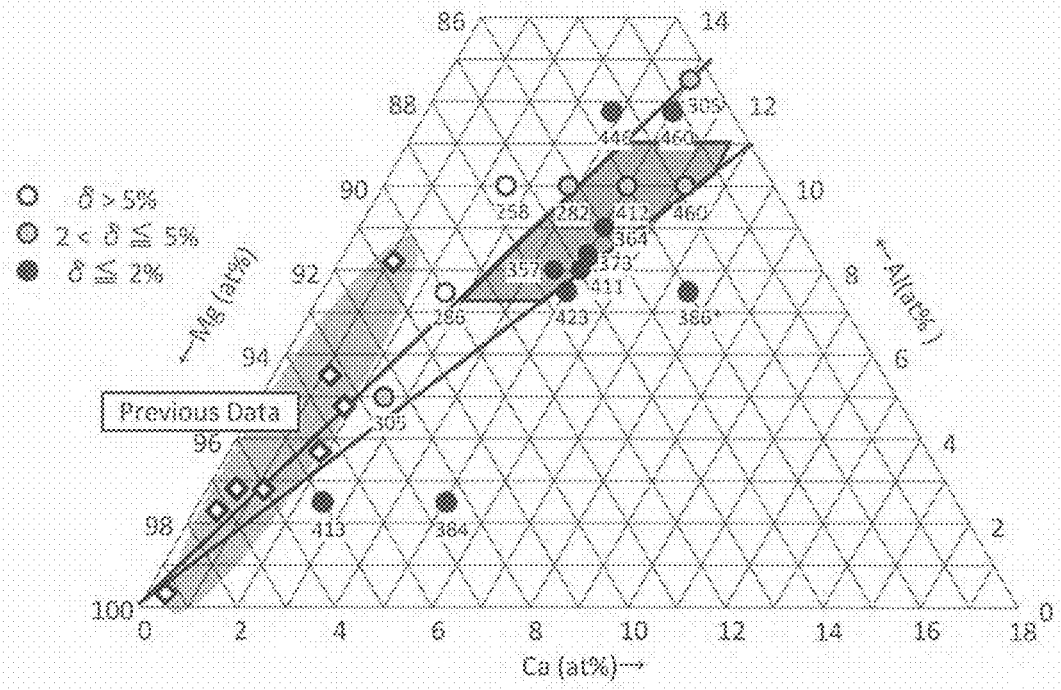
FIG. 2 is a diagram illustrating results when a tensile test was performed on the $Mg_{100-a-b}Ca_aAl_b$ alloy cast extruded materials at room temperature.

In FIGS. 1 and 2, 0.2% tensile yield strength (MPa) and the elongation (hereinafter, abbreviated as 8) of the $Mg_{100-a-b}Ca_aAl_b$ alloy cast extruded materials are shown as ternary strength diagrams. In FIGS. 1 and 2, materials in which δ is more than 5% are represented by white circles, materials in which δ is more than 2% and equal to or less than 5% are represented by gray circles and materials in which δ is equal to or less than 2% are represented by black circles.

It was confirmed that, in order to obtain the magnesium alloy having the mechanical properties of high strength and high ductility, the composition preferably fell within the first composition range illustrated in FIG. 1, and that the composition more preferably fell within the second composition range illustrated in FIG. 2. Furthermore, as illustrated in FIGS. 1 and 2, it was found that an alloy group in which the addition amount of Al is 10 atomic % exhibited high strength and high ductility.

Moreover, as shown in Table 1, it was confirmed that the ratio of the compression yield strength to the tensile yield strength was equal to or more than 0.8.

(Structure Observation of Cast Extruded Material)

Figure 3:
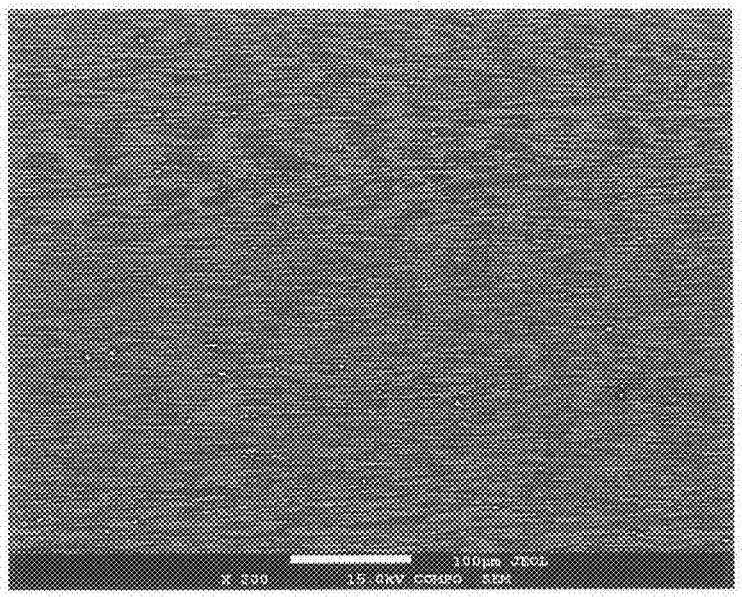
FIG. 3 is a structure photograph (SEM image) of an $Mg_{85}Al_{10}Ca_5$ alloy extruded material.

FIG. 3 shows a structure photograph (SEM image) of an $Mg_{85}Al_{10}Ca_5$ alloy extruded material among the samples produced as described above. It was observed that in the $Mg_{85}Al_{10}Ca_5$ alloy extruded material, $(Mg, Al)_2Ca$ (C36 type compound) was effectively dispersed and that $(Mg, Al)_2Ca$ was dispersed in the metal structure at a high volume fraction.

It was confirmed, from the SEM images of the $Mg_{100-a-b}Ca_aAl_b$ alloy extruded materials in the first composition range illustrated in FIG. 1 among the samples produced as described above, that the volume fraction of the region obtained by dispersing $(Mg, Al)_2Ca$ was equal to or more than 35% and equal to or less than 65%, and that in the $Mg_{100-a-b}Ca_aAl_b$ alloy extruded materials having more excellent mechanical properties (high strength and high ductility), the volume fraction thereof was equal to or more than 35% and equal to or less than 55%.

In addition, as a result of the observation of the dispersion degree of $(Mg, Al)_2Ca$ from the SEM images of the $Mg_{100-a-b}Ca_aAl_b$ alloy extruded materials in the first composition range illustrated in FIG. 1 among the samples produced as described above, it was confirmed that the dispersion degree was substantially equal to or more than 1 piece/$\mu m^2$.

Furthermore, as a result of the observation of the aspect ratio of the crystal grain of $(Mg, Al)_2Ca$ from the SEM images of the $Mg_{100-a-b}Ca_aAl_b$ alloy extruded materials in the first composition range illustrated in FIG. 1 among the samples produced as described above, it was confirmed that the aspect ratio was approximately 1, and that $(Mg, Al)_2Ca$ was an equiaxed crystal.

Moreover, it was confirmed, from the SEM images of the $Mg_{100-a-b}Ca_aAl_b$ alloy extruded materials in the first composition range illustrated in FIG. 1 among the samples produced as described above, that the upper limit of the crystal grain diameter of $(Mg, Al)_2Ca$ was 2 μm.

Figure 4:
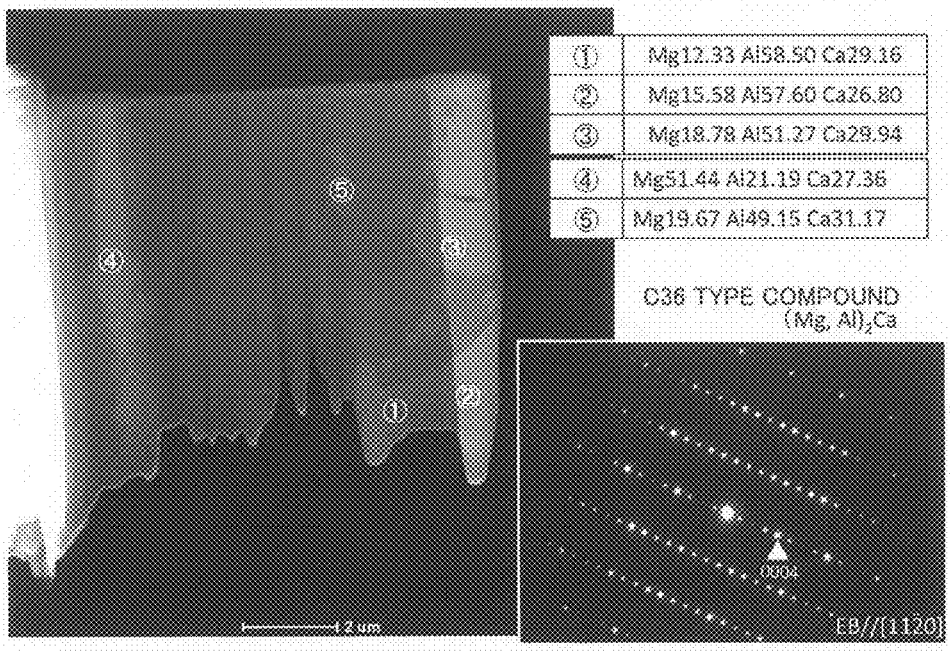
FIG. 4 shows a TEM image and an electron beam diffraction pattern of $(Mg, Al)_2Ca$ in an $Mg_{83.75}Al_{10}Ca_{6.25}$ alloy extruded material.

FIG. 4 shows a TEM image and an electron beam diffraction pattern of $(Mg, Al)_2Ca$ in an $Mg_{83.75}Al_{10}Ca_{6.25}$ alloy extruded material among the samples produced as described above.

As illustrated in FIG. 4, the presence of $(Mg, Al)_2Ca$ was able to be confirmed even with a TEM, and thus it was confirmed that the compound was $(Mg, Al)_2Ca$.

A large number of samples each having a crystal grain diameter of $(Mg, Al)_2Ca$ being equal to or less than 10 nm were observed from the TEM images of the $Mg_{100-a-b}Ca_aAl_b$ alloy extruded materials in the first composition range illustrated in FIG. 1 among the samples produced as described above, and it was confirmed that the lower limit thereof was 1 nm.

Figure 5:
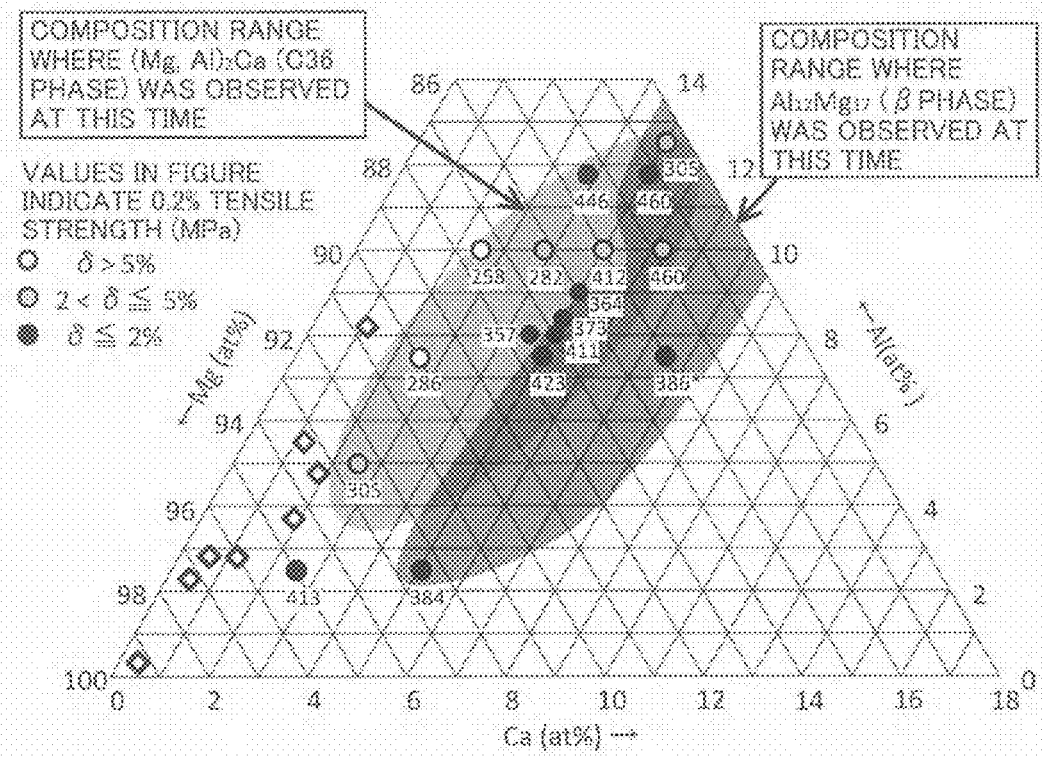
FIG. 5 is a diagram illustrating the formation phases and the mechanical properties of $Mg_{100-a-b}Ca_aAl_b$ alloys (a: 2.5 to 7.5 at. %, b: 2.5 to 12.5 at. %) alloy extruded materials.

FIG. 5 is a diagram illustrating the formation phases and the mechanical properties of $Mg_{100-a-b}Ca_aAl_b$ alloys (a: 2.5 to 7.5 at. %, b: 2.5 to 12.5 at. %) alloy extruded materials.

It was confirmed from FIG. 5 that, in the first composition range illustrated in FIG. 1 and the second composition range illustrated in FIG. 2, a range obtained by forming $(Mg, Al)_2Ca$ and a region obtained by forming $(Mg, Al)_2Ca$ and $Al_{12}Mg_{17}$ were present.

Furthermore, it was confirmed from the measurement of the above formation phases that the magnesium alloys of the samples in the first composition range illustrated in FIG. 1 contained 10 volume % or more and 35 volume % or less of $(Mg, Al)_2Ca$ and 0 volume % or more and 10 volume % or less of $Al_{12}Mg_{17}$.

Figure 6:
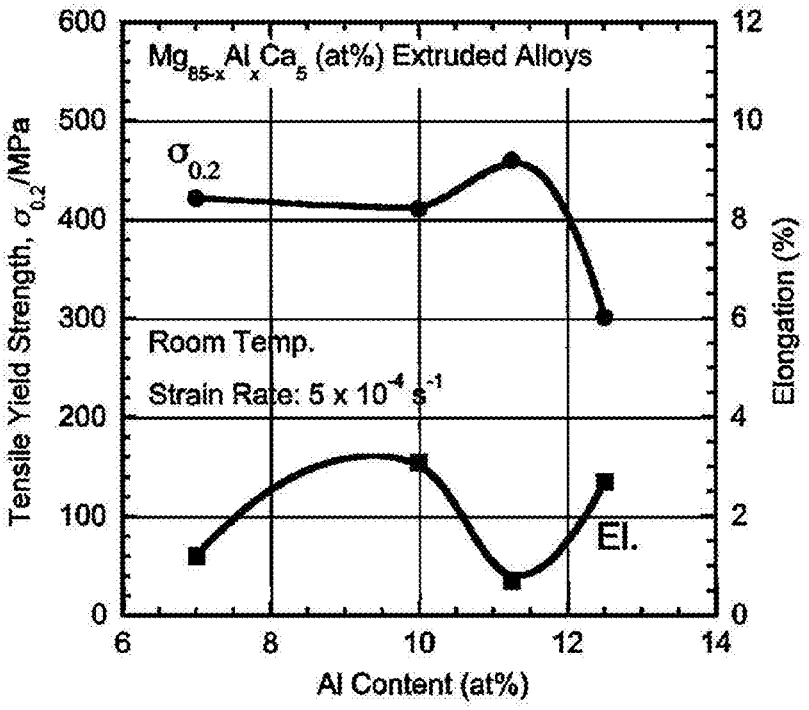
FIG. 6 is a diagram illustrating the dependence of the mechanical properties of $Mg_{95-x}Al_xCa_5$ alloy extruded materials on the addition amount of Al.

FIG. 6 is a diagram illustrating the dependence of the mechanical properties of $Mg_{95-x}Al_xCa_5$ alloy extruded materials on the addition amount of Al, the horizontal axis represents the content x of Al and the vertical axis represents 0.2% tensile yield strength YS.

As illustrated in FIG. 6, it was confirmed that, when the addition amount of Al exceeded 12 atomic %, 0.2% tensile yield strength was rapidly lowered, and it was found that the upper limit of the addition amount of Al was preferably 12 atomic % and was more preferably 11 atomic %.

Figure 7:
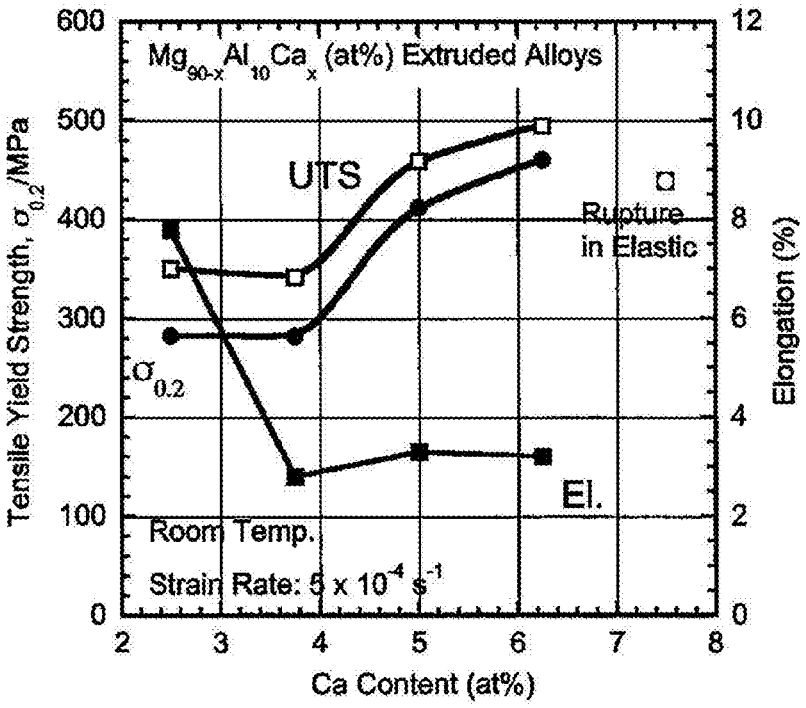
FIG. 7 is a diagram illustrating the dependence of the mechanical properties of $Mg_{90-x}Al_{10}Ca_x$ alloy extruded materials on the addition amount of Ca.

FIG. 7 is a diagram illustrating the dependence of the mechanical properties of $Mg_{90-x}Al_{10}Ca_x$ alloy extruded materials on the addition amount of Ca, the horizontal axis represents the content x of Ca and the vertical axis represents 0.2% tensile yield strength YS.

As illustrated in FIG. 7, it was confirmed that, when the addition amount of Ca exceeded 3.75 atomic %, 0.2% tensile yield strength was rapidly increased. Furthermore, it was found that, when the addition amount of Ca was 6.25 atomic %, the highest strength was exhibited, whereas when 7.5 atomic % or more of Ca was added, no ductility was exhibited, and a break occurred within an elastic limit. Therefore, it was confirmed that the upper limit of the addition amount of Ca was preferably set at 7 atomic %.

Figure 8:
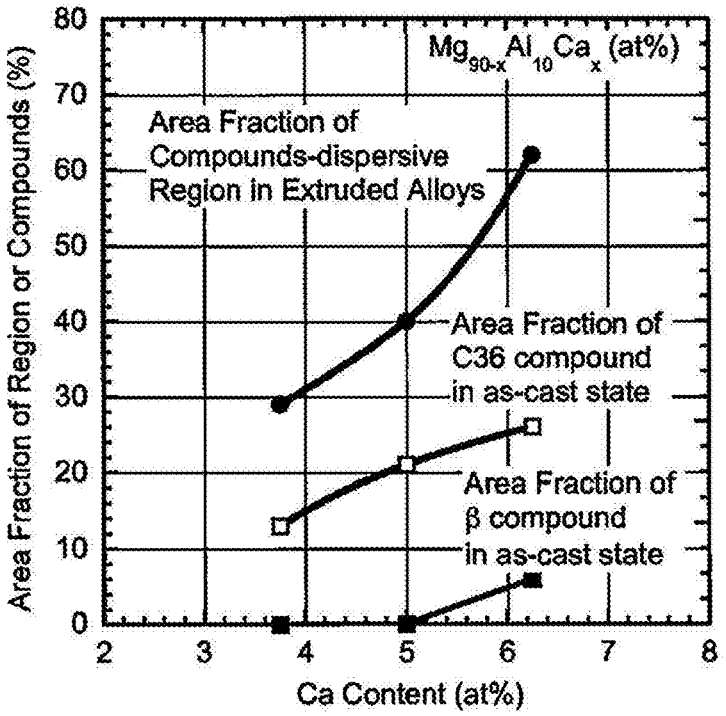
FIG. 8 is a diagram illustrating the dependence of the structure change of $Mg_{90-x}Al_{10}Ca_x$ alloy extruded materials on the addition amount of Ca.

FIG. 8 is a diagram illustrating the dependence of the structure change of $Mg_{90-x}Al_{10}Ca_x$ alloy extruded materials on the addition amount of Ca, the horizontal axis represents the content x of Ca and the vertical axis represents the dispersion region of the compound or the volume fraction of the compound.

As illustrated in FIG. 8, it was found that the β phase ($Al_{12}Mg_{17}$) indicated by "■" was within a range of 0 to 10% as a result of a measurement in a cast state, it was found that the C36 type compound ($(Mg, Al)_2Ca$) indicated by "□" was within a range of 10 to 30% as a result of a measurement in the cast state, and it was found that the volume fraction of the dispersion region of the compound (the dispersion region of the C36 type compound and the β phase) indicted by "•" was within a range of 25 to 65% as a result of a measurement with the extruded material. The volume fraction of the dispersion region of the compound is preferably within a range of 35 to 65% except magnesium alloys whose YS is equal to or less than 300 MPa.

It was confirmed from FIGS. 7 and 8 that as the content of the C36 type compound was increased, 0.2% tensile yield strength was increased.

Figure 9:
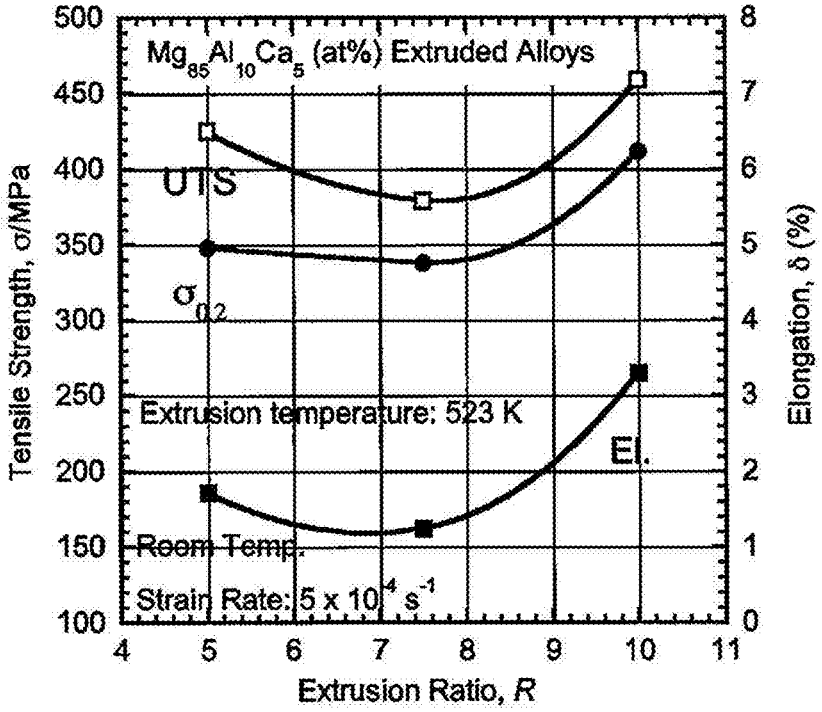
FIG. 9 is a diagram illustrating the dependence of the mechanical properties of $Mg_{85}Al_{10}Ca_5$ alloy extruded materials on an extrusion ratio.

FIG. 9 is a diagram illustrating the dependence of the mechanical properties of $Mg_{85}Al_{10}Ca_5$ alloy extruded materials on the extrusion ratio, the horizontal axis represents the extrusion ratio, the vertical axis on the left side represents UTS tensile strength and 0.2% tensile yield strength $\sigma_{0.2}$ and the vertical axis on the right side represents the elongation δ.

As illustrated in FIG. 9, it was confirmed that an elongation of 2% or more was obtained by performing extrusion processing at an extrusion ratio of 9 or more (equivalent strain of 2.2 or more).

Figure 10:
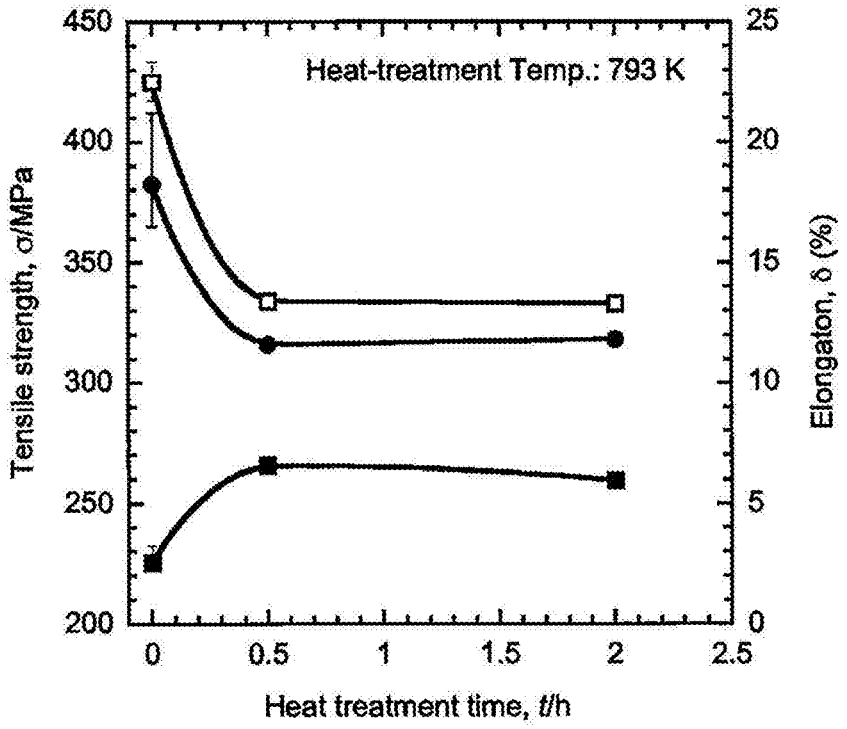
FIG. 10 is a diagram illustrating the results of the evaluation of the mechanical properties of $Mg_{85}Al_{10}Ca_5$ alloy heat treatment extruded materials in a tensile test at room temperature.

FIG. 10 is a diagram illustrating the evaluation results, in a tensile test at room temperature, of the mechanical properties of extruded materials obtained by performing heat treatment on $Mg_{85}Al_{10}Ca_5$ alloy cast materials at a temperature of 793K for 1 hour, 0.5 hours and 2 hours and then by performing extrusion processing at a temperature of 523K, at an extrusion ratio of 10, and at an extrusion rate of 2.5 mm/second, the horizontal axis represents a heat treatment time, the vertical axis on the left side represents the tensile strength $\sigma_{UTS}$ and 0.2% tensile yield strength $\sigma_{0.2}$ and the vertical axis on the right side represents the elongation δ.

As illustrated in FIG. 10, the heat treatment is performed on the cast material before the plastic processing, and thus it is possible to significantly increase the elongation. Note that it is expected that it is possible to realize an effect of enhancing the elongation by the heat treatment for approximately 5 minutes.

Figure 11:
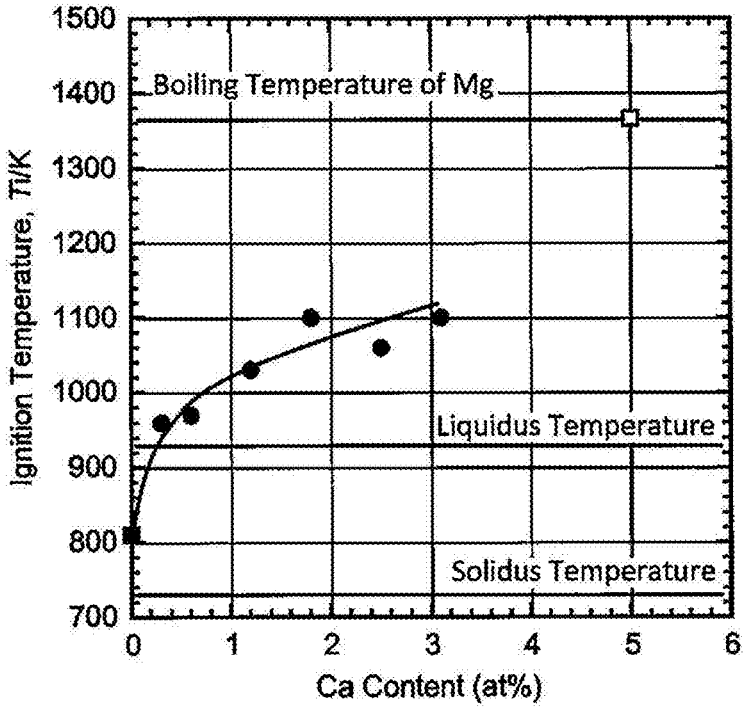
FIG. 11 is a diagram illustrating the dependence of the ignition temperature of $Mg_{85}Al_{10}Ca_5$ alloy materials on the addition amount of Ca.

FIG. 11 is a diagram illustrating the dependence of the ignition temperature of alloy materials (Ca-containing AZ91-based Alloys) obtained by containing 0 to 3.1 atomic % of Ca in AZ91 alloys according to ASTM standards and $Mg_{85}Al_{10}Ca_5$ alloy materials on the addition amount of Ca, and the horizontal axis represents the addition amount of Ca and the vertical axis represents the ignition temperature.

It was found from the combustion test of FIG. 11 that, when the addition amount of Ca was equal to or more than 3 atomic %, the ignition temperature was equal to or more than 1123K (850° C.), whereas when the addition amount of Ca was equal to or more than 5 atomic, the ignition temperature was equal to or more than 1363K (1090° C.).

Figure 12:
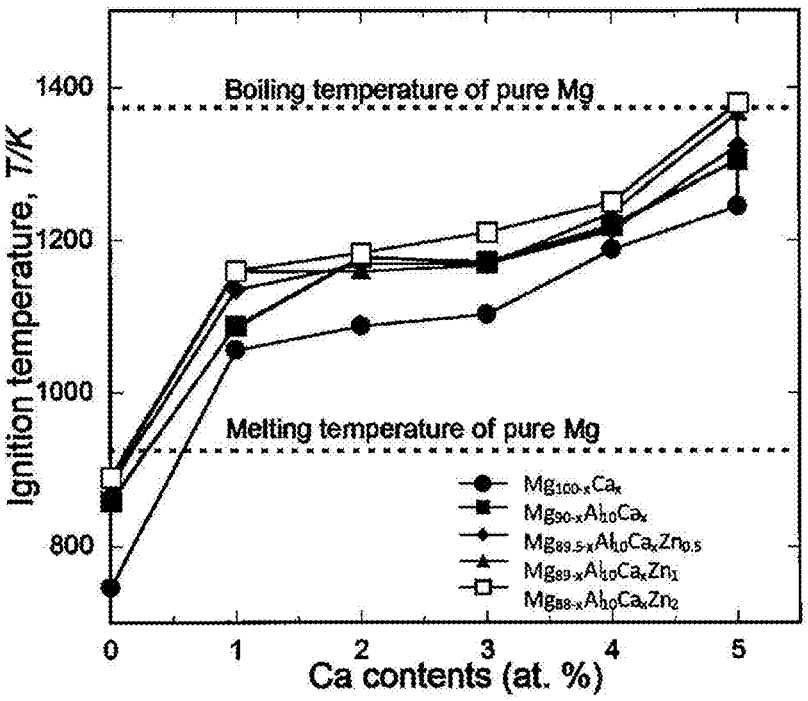
FIG. 12 is a diagram illustrating the dependence of the ignition temperature of $Mg_{100-x}Ca_x$ (x=0 to 5) alloy materials and the like on the addition amount of Ca.

FIG. 12 is a diagram illustrating the dependence of each of the ignition temperatures of $Mg_{100-x}Ca_x$ (x=0 to 5) alloy materials, $Mg_{90-x}Al_{10}Ca_x$ (x=0 to 5) alloy materials, $Mg_{89.5-x}Al_{10}Ca_xZn_{0.5}$ (x=0 to 5) alloy materials, $Mg_{89-x}Al_{10}Ca_xZn_1$ (x=0 to 5) alloy materials and $Mg_{88-x}Al_{10}Ca_xZn_2$ (x=0 to 5) alloy materials on the addition amount of Ca, and the horizontal axis represents the addition amount of Ca and the vertical axis represents the ignition temperature.

It was found from the combustion test of FIG. 12 that when the addition amount of Zn was increased, the ignition temperature was increased.

Figure 13:
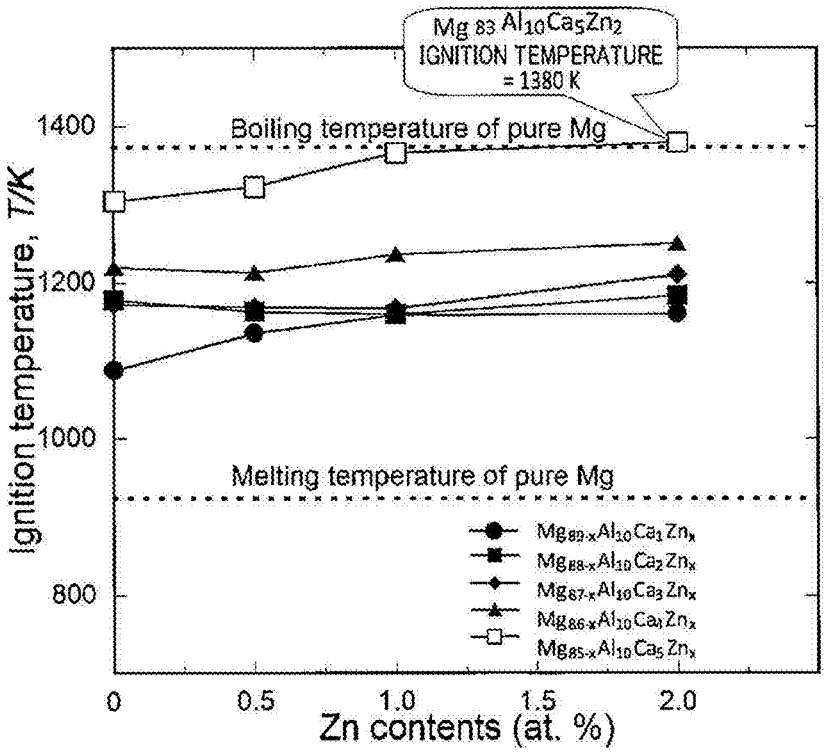
FIG. 13 is a diagram illustrating the dependence of the ignition temperature of $Mg_{89-x}Al_{10}Ca_1Zn_x$ (x=0 to 2.0) alloy materials and the like on the addition amount of Zn.

FIG. 13 is a diagram illustrating the dependence of each of the ignition temperatures of $Mg_{89-x}Al_{10}Ca_1Zn_x$ (x=0 to 2.0) alloy materials, $Mg_{88-x}Al_{10}Ca_2Zn_x$ (x=0 to 2.0) alloy materials, $Mg_{87-x}Al_{10}Ca_3Zn_x$ (x=0 to 2.0) alloy materials, $Mg_{86-x}Al_{10}Ca_4Zn_x$ (x=0 to 2.0) alloy materials and $Mg_{85-x}Al_{10}Ca_5Zn_x$ (x=0 to 2.0) alloy materials on the addition amount of Zn, and the horizontal axis represents the addition amount of Zn and the vertical axis represents the ignition temperature.

It was found from the combustion test of FIG. 13 that, when the addition amount of Ca was increased, the ignition temperature was increased. Furthermore, in the $Mg_{83}Al_{10}Ca_5Zn_2$ alloy material, the ignition temperature was 1380K. The $Mg_{B3}Al_{10}Ca_5Zn_2$ alloy was produced in the same method as the samples shown in Table 1, and the mechanical properties thereof were measured, with the result that it was confirmed that the yield stress was 380 MPa.

Figure 14:
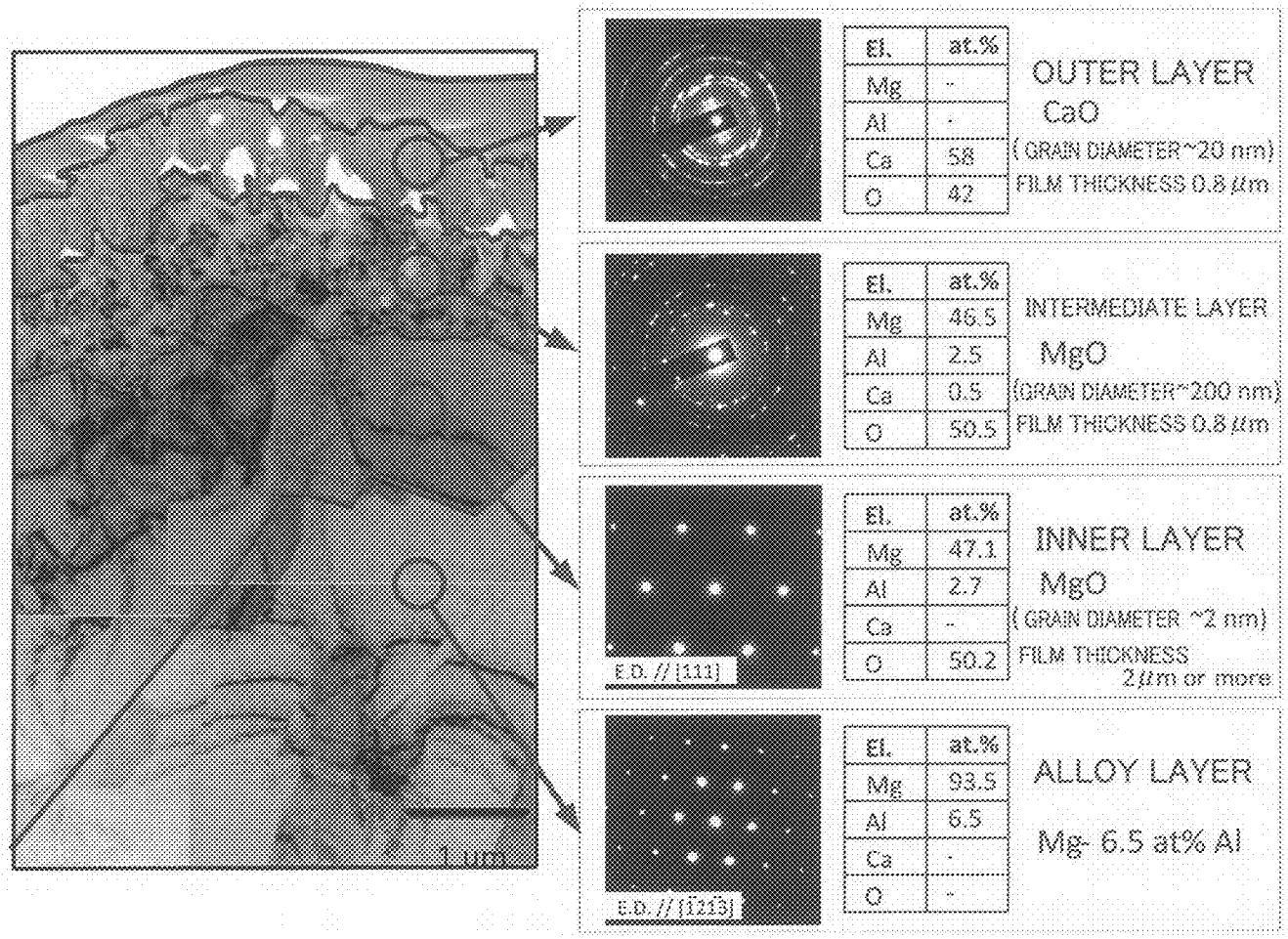
FIG. 14 is a photograph illustrating the structure of the surface film of an alloy sample obtained by melting an $Mg_{85}Al_{10}Ca_5$ alloy in the atmosphere and diagrams illustrating the results of analysis of the film.

FIG. 14 is a diagram illustrating photographs illustrating the structure of the surface film of an alloy sample obtained by melting the $Mg_{85}Al_{10}Ca_5$ alloy in the atmosphere and the results of analysis of the film.

Figure 15:
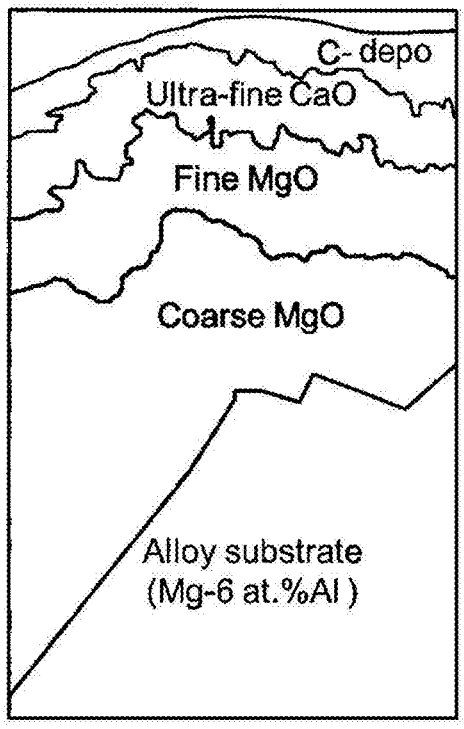
FIG. 15 is a diagram schematically illustrating the surface film of the alloy sample shown in FIG. 14.

FIG. 15 is a diagram schematically illustrating the surface film of the alloy sample shown in FIG. 14.

<Nonflammable Expression Mechanism>

It was confirmed from FIGS. 14 and 15 that the surface film formed during the melting of the $Mg_{85}Al_{10}Ca_5$ alloy had a three-layer structure, and that the surface film was formed of a ultrafine grain CaO layer, a fine grain MgO layer and a coarse MgO layer when sequentially seen from the surface layer. As described above, it is suggested that the formation of the ultrafine grain CaO layer during the melting significantly contributes to the expression of nonflammability.

(Corrosion Test)

A corrosion test was performed on the magnesium alloys of compositions shown in Table 2. The conditions of corrosion were that the magnesium alloys were immersed in a 1 wt % NaCl aqueous solution (initial pH=6.8), and that a corrosion rate was measured. The results thereof are shown in Table 2.

TABLE 2

Conditions of corrosion: immersion in 1 wt % NaCl aqueous solution (initial pH = 6.8)

| Composition [at.%] | Corrosion rate [mm/year] |
|---|---|
| $Mg_{85}Ca_5Al_{10}$ | 2.85 |
| $Mg_{90}Al_{10}$ | 6.04 |
| $Mg_{95}Ca_5$ | 10.1 |
| $Mg_{84.9}Al_{10}Ca_5Zn_{0.1}$ | 1.57 |
| $Mg_{84.9}Al_{10}Ca_5Mn_{0.1}$ | 0.26 |
| $Mg_{84.9}Al_{10}Ca_5Zr_{0.1}$ | 22.95 |
| $Mg_{84.9}Al_{10}Ca_5Y_{0.1}$ | 9.012 |
| $Mg_{84.9}Al_{10}Ca_5La_{0.1}$ | 4.78 |
| $Mg_{84.9}Al_{10}Ca_5Ce_{0.1}$ | 11.44 |
| $Mg_{84.9}Al_{10}Ca_5Nd_{0.1}$ | 22.2 |

According to Table 2, the $Mg_{84.9}Al_{10}Ca_5Mn_{0.1}$ alloy and the $Mg_{84.9}Al_{10}Ca_5Zn_{0.1}$ alloy obtained by adding small amounts of Mn and Zn exhibited high corrosion resistance.

Example 2

(Production of Samples)

First, ingots (cast materials) of $Mg_{85}Al_{10}Ca_5$ alloys and $Mg_{85-x}Al_{10}Ca_5X_x$ alloys (X: Mn, Zn, Zr, Ag, Y, La, Ce, Nd, Gd, x: 0.1 to 0.3 at. %) of compositions shown in Table 3 were produced by high-frequency induction melting in an atmosphere of Ar gas, and extrusion billets which were cut from these ingots into the shape of ϕ 29×65 mm were prepared. Then, extrusion processing was performed on the extrusion billets under the following conditions. The extrusion processing was performed at an extrusion ratio of 10, at an extrusion temperature of 523K, and at an extrusion rate of 2.5 mm/second.

(Corrosion Property by Addition of Fourth Element to Cast Extruded Material)

Figure 16:
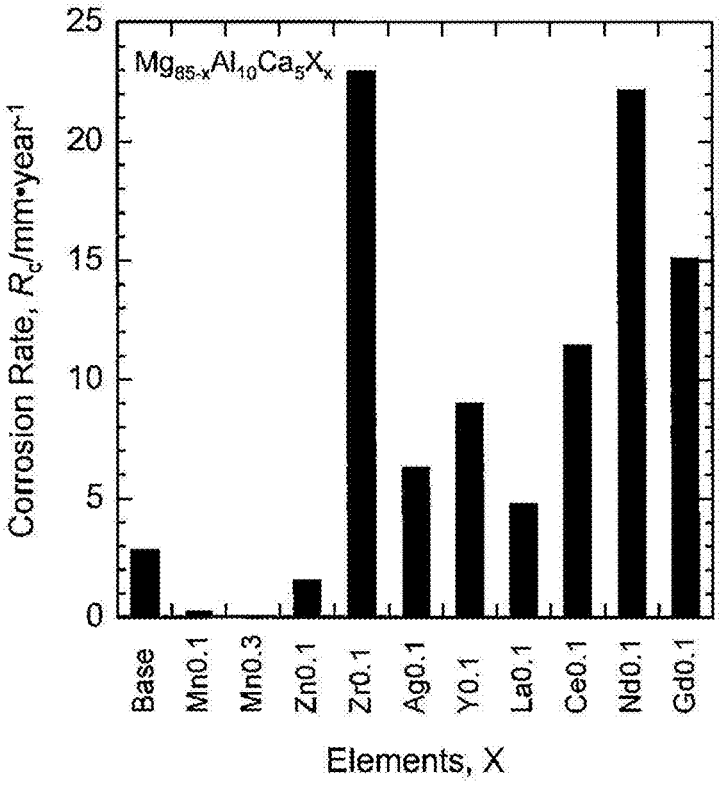
FIG. 16 is a diagram illustrating a relationship between magnesium alloys and corrosion rates shown in Table 3.
Figure 17:
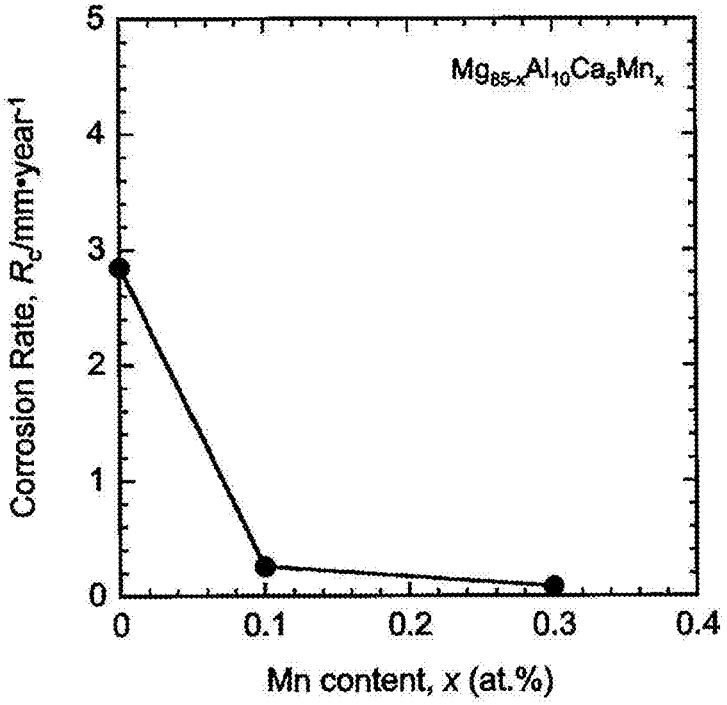
FIG. 17 is a diagram illustrating a relationship between $Mg_{85-x}Al_{10}Ca_5Mn_x$ alloys (x: 0 to 0.3 at. %) and the corrosion rates.

A corrosion test was performed on the cast extruded material obtained by performing the above extrusion processing. Specifically, the cast extruded material was immersed in a 1 wt % NaCl neutral aqueous solution (pH=6.8), and a corrosion rate was measured. The results thereof are shown in Table 3 and FIGS. 16 and 17. FIG. 16 is a diagram illustrating a relationship between the magnesium alloys and the corrosion rates shown in Table 3. FIG. 17 is a diagram illustrating a relationship between the $Mg_{85-x}Al_{10}Ca_5Mn_x$ alloys (x: 0 to 0.3 at. %) and the corrosion rates.

TABLE 3

Addition of fourth element to $Mg_{85}Al_{10}Ca_5$ alloy: corrosion resistance Corrosion test conditions: 1 wt % NaCl neutral aqueous solution (pH = 6.8)

| | Additive Element, at % | Corrosion Rate (mm/year) |
|---|---|---|
| $Mg_{85}Al_{10}Ca_5$ | (Base alloy) | 2.85 |
| $Mg_{85-x}Al_{10}Ca_5X_x$ | Mn0.1 | 0.26 |
| | Mn0.3 | 0.084 |
| | Zn0.1 | 1.57 |
| | Zr0.1 | 22.94 |
| | Ag0.1 | 6.28 |
| | Y0.1 | 9.01 |
| | La0.1 | 4.78 |
| | Ce0.1 | 11.44 |
| | Nd0.1 | 22.2 |
| | Gd0.1 | 15.14 |

As shown in Table 3 and FIG. 16, it was able to be confirmed that the corrosion resistance of the magnesium alloys was enhanced by the addition of 0.1 to 0.3 at. % of Mn or Zn. Furthermore, as illustrated in FIG. 17, it was able to be confirmed that the corrosion resistance of the magnesium alloys was enhanced by the addition of 0.1 at. % or more of Mn.

(Nonflammable Property by Addition of Fourth Element to Cast Extruded Material)

Figure 18:
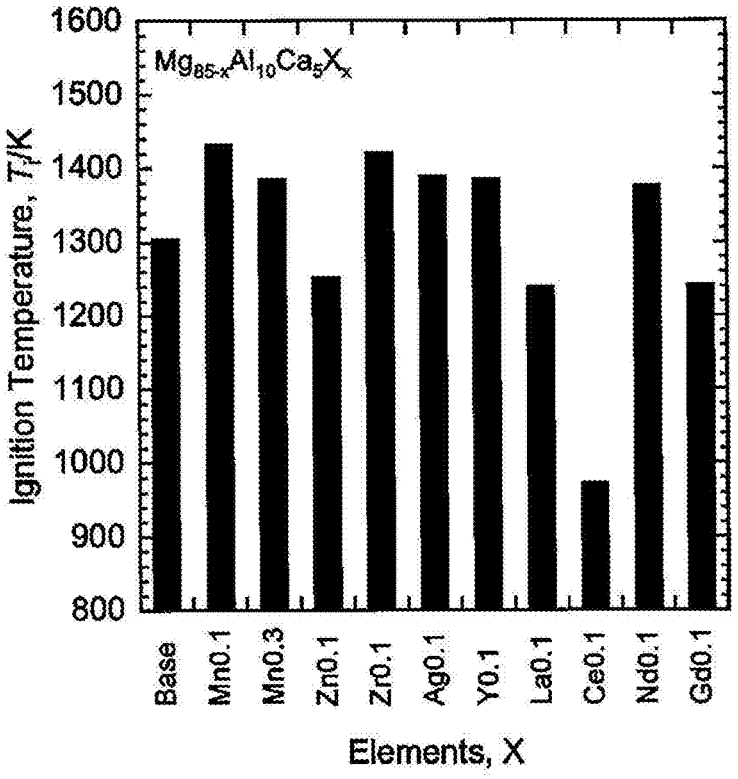
FIG. 18 is a diagram illustrating a relationship between magnesium alloys and ignition temperatures shown in Table 4.
Figure 19:
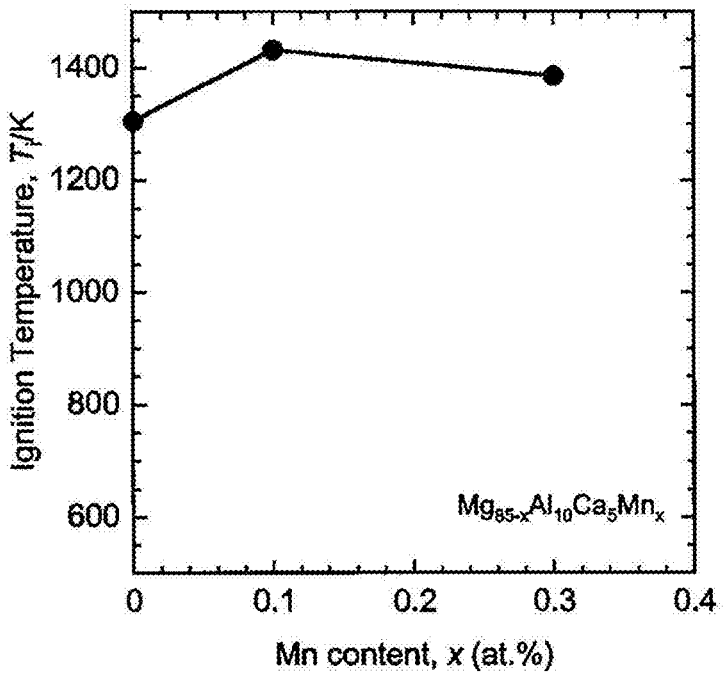
FIG. 19 is a diagram illustrating a relationship between $Mg_{85-x}Al_{10}Ca_5Mn_x$ alloys (x: 0 to 0.3 at. %) and ignition temperatures.

A nonflammable property test was performed using the same cast extruded material as the samples obtained by performing the above corrosion test. Specifically, the ignition temperatures of the cast extruded materials of compositions shown in Table 4 were measured, and the results thereof are shown in Table 4 and FIGS. 18 and 19. FIG. 18 is a diagram illustrating a relationship between the magnesium alloys and the ignition temperatures shown in Table 4. FIG. 19 is a diagram illustrating a relationship between the $Mg_{85-x}Al_{10}Ca_5Mn_x$ alloys (x: 0 to 0.3 at. %) and the ignition temperatures.

TABLE 4

Addition of fourth element to $Mg_{85}Al_{10}Ca_5$ alloy: nonflammability

| | Additive Element, at % | Ignition Temp. (K) |
|---|---|---|
| $Mg_{85}Al_{10}Ca_5$ | (Base alloy) | 1305 |
| $Mg_{85-x}Al_{10}Ca_5X_x$ | Mn0.1 | 1432 |
| | Mn0.3 | 1386 |
| | Zn0.1 | 1253 |
| | Zr0.1 | 1421 |
| | Ag0.1 | 1390 |
| | Y0.1 | 1386 |
| | La0.1 | 1240 |
| | Ce0.1 | 973 |
| | Nd0.1 | 1377 |
| | Gd0.1 | 1242 |

As shown in Table 4 and FIG. 18, it was able to be confirmed that the ignition temperatures of the magnesium alloys were increased by the addition of 0.1 to 0.3 at. % of Mn, Zr, Ag, Y or Nd. As illustrated in FIG. 19, it was able to be confirmed that the ignition temperatures of the magnesium alloys were sufficiently increased by the addition of 0.1 at. % of Mn.

Furthermore, it was confirmed from the results of the corrosion test and the ignition temperature measurement as described above that it was possible to simultaneously enhance the corrosion resistance and the nonflammability by the addition of Mn.

(Mechanical Properties of Cast Extruded Materials)

Figure 20:
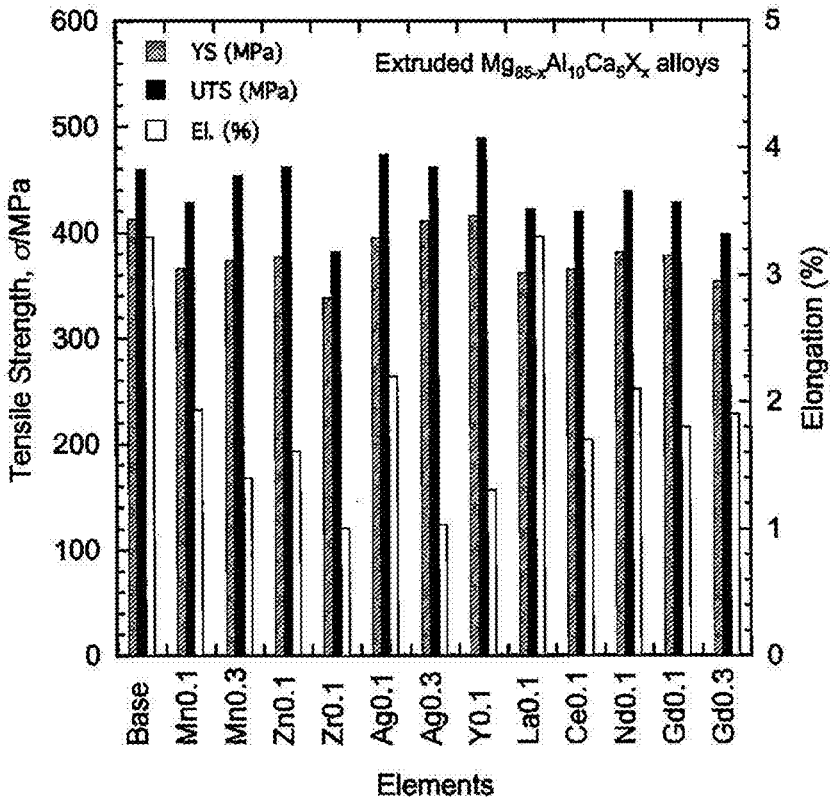
FIG. 20 is a diagram illustrating the mechanical properties of cast extruded materials.

A tensile test was performed at room temperature on the cast extruded materials of the $Mg_{85}Al_{10}Ca_5$ alloys and the $Mg_{85-x}Al_{10}Ca_5X_x$ alloys (X: Mn, Zn, Zr, Ag, Y, La, Ce, Nd, Gd, x: 0.1 to 0.3 at. %) of compositions shown in Table 5 produced in the same method as the samples obtained by performing the the above corrosion test. The results thereof are shown in Table 5 and FIG. 20. FIG. 20 is a diagram illustrating the mechanical properties of the above cast extruded materials. Note that, in Table 5, TYS indicates 0.2% tensile yield strength, and UTS indicates the tensile strength. Furthermore, in FIG. 20, YS indicates 0.2% tensile yield strength, UTS indicates the tensile strength and EI indicates the elongation.

TABLE 5

Addition of fourth element to $Mg_{85}Al_{10}Ca_5$ alloy: mechanical properties Extrusion conditions: extrusion temperature of 523 K, extrusion ratio of R10 and extrusion ram rate of 2.5 mm/s

| | Additive Element, at % | TYS (MPa) | UTS (MPa) | Elongation (%) |
|---|---|---|---|---|
| $Mg_{85}Al_{10}Ca_5$ | (Base alloy) | 412 | 459 | 3.3 |
| $Mg_{85-x}Al_{10}Ca_5X_x$ | Mn0.1 | 366 | 428 | 1.9 |
| | Mn0.3 | 374 | 454 | 1.4 |
| | Zn0.1 | 377 | 461 | 1.6 |
| | Zr0.1 | 338 | 382 | 1 |
| | Ag0.1 | 395 | 473 | 2.2 |
| | Ag0.3 | 410 | 461 | 1.0 |
| | Y0.1 | 415 | 489 | 1.3 |
| | La0.1 | 362 | 422 | 3.3 |
| | Ce0.1 | 365 | 419 | 1.7 |
| | Nd0.1 | 381 | 438 | 2.1 |
| | Gd0.1 | 378 | 428 | 1.8 |
| | Gd0.3 | 354 | 398 | 1.9 |

As shown in Table 5 and FIG. 20, the strength or the ductility was lowered by the addition of Mn, Zn, Zr, Ag, Y, La, Ce, Nd or Gd.

The following was able to be confirmed from the results of the corrosion test, the ignition temperature measurement and the tensile test as described above. Although it is possible to enhance the corrosion resistance and the nonflammability by the addition of Mn, the strength and the ductility are slightly lowered. Furthermore, although it is possible to enhance the corrosion resistance by the addition of Zn, the strength and the ductility are slightly lowered. Moreover, although it is possible to enhance the nonflammability by the addition of Zr, Ag, Y or Nd, at least one of the strength and the ductility is slightly lowered.

(Effect of Heat Treatment Before Extrusion of $Mg_{85}Al_{10}Ca_5$ Cast Extruded Material)

Extrusion billets of the $Mg_{85}Al_{10}Ca_5$ alloy were prepared in the same method as the samples obtained by performing the above corrosion test, and heat treatment under temperature conditions and processing times shown in Table 5 was performed on the extrusion billets. Then, extrusion processing was performed on the extrusion billets under the following conditions. The extrusion processing was performed at an extrusion ratio of 10, at an extrusion temperature of 523K, and at an extrusion rate of 2.5 mm/second.

Figure 21:
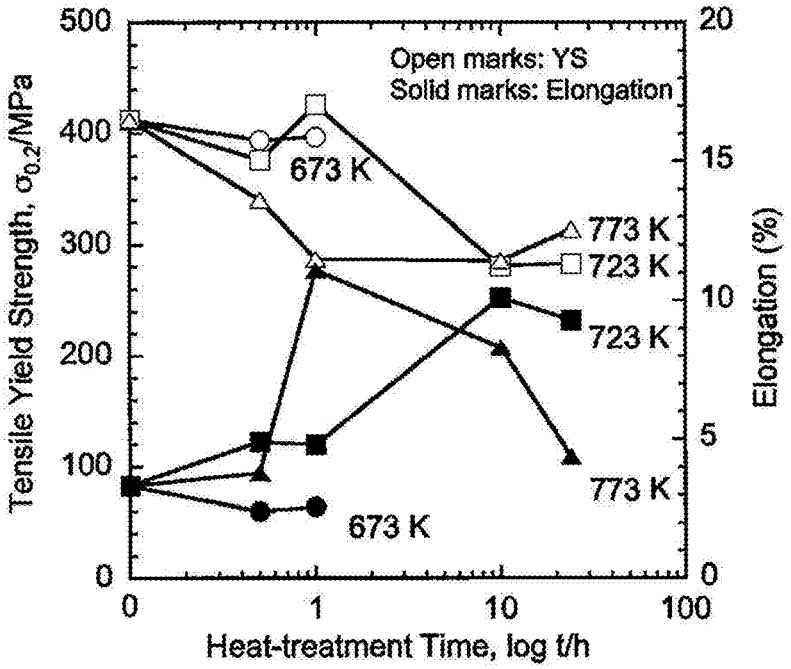
FIG. 21 is a diagram illustrating the results of the evaluation of the mechanical properties of the $Mg_{85}Al_{10}Ca_5$ cast extruded material.

A tensile test was performed at room temperature on the $Mg_{85}Al_{10}Ca_5$ alloy cast extruded material obtained by performing the above extrusion processing. The results thereof are shown in Table 6 and FIG. 21. FIG. 21 is a diagram illustrating the evaluation results of the mechanical properties of the $Mg_{85}Al_{10}Ca_5$ cast extruded material in the tensile test at room temperature, the horizontal axis represents the heat treatment time, and the vertical axis on the left side represents the tensile strength (UTS) and 0.2% tensile yield strength (YS) $\sigma_{0.2}$ and the vertical axis on the right side represents the elongation.

TABLE 6

Effect of thermal processing before extrusion of $Mg_{85}Al_{10}Ca_5$ alloy: enhancement of ductility

| | Heat-treatment Temperature (K) | Heat-treatment Time (h) | TYS (MPa) | UTS (MPa) | Elongation (%) |
|---|---|---|---|---|---|
| $Mg_{85}Al_{10}Ca_5$ | 673 | 0.5 | 394 | 448 | 2.4 |
| | | 1 | 397 | 446 | 2.6 |
| | 723 | 0.5 | 376 | 411 | 4.9 |
| | | 1 | 426 | 468 | 4.8 |
| | | 10 | 281 | 328 | 10.1 |
| | | 24 | 283 | 333 | 9.3 |
| | 773 | 0.5 | 340 | 411 | 3.8 |
| | | 1 | 287 | 336 | 11.1 |
| | | 10 | 286 | 336 | 8.3 |
| | | 24 | 314 | 340 | 4.4 |

As shown in Table 6 and FIG. 21, it was able to be confirmed that heat treatment was performed on the cast material for 0.5 hours or more in a temperature range of 723 to 773K before the extrusion processing and thus a ductility of 10% or more was expressed while a YS of 280 MPa or more was retained.

Example 3

(Production of Samples)

First, ingots (cast materials) of compositions shown in Table 7 were produced by high-frequency induction melting in an atmosphere of Ar gas, and extrusion billets cut from these ingots into the shape of (1) 29×65 mm were prepared. Then, extrusion processing was performed on the extrusion billets under the following conditions. The extrusion processing was performed at an extrusion ratio of 10, at an extrusion temperature of 523K, and at an extrusion ram rate of 2.5 mm/second.

(Mechanical Properties of Cast Extruded Material)

A tensile test was performed, at room temperature, on the alloy cast extruded materials obtained by performing the above extrusion processing. The results thereof are shown in Table 7 and FIG. 22. In the vertical axis of the graph illustrated in FIG. 22, "Yield strength" represents the yield strength (0.2% tensile yield strength), and "Elongation" represents the elongation, and the horizontal axis of the graph illustrated in FIG. 22 represents the content of Mn.

TABLE 7

| Composition | Yield strength [MPa] | Maximum strength [MPa] | Elongation [%] |
|---|---|---|---|
| $Mg_{85}Al_{10}Ca_5$ | 412 | 459 | 3.3 |
| $Mg_{84.95}Al_{10}Ca_5Mn_{0.05}$ | 414 | 474 | 2.23 |
| $Mg_{84.9}Al_{10}Ca_5Mn_{0.1}$ | 415 | 477 | 2.03 |
| $Mg_{84.8}Al_{10}Ca_5Mn_{0.2}$ | 409 | 478 | 2.09 |
| $Mg_{84.7}Al_{10}Ca_5Mn_{0.3}$ | 420 | 475 | 1.42 |

Figure 22:
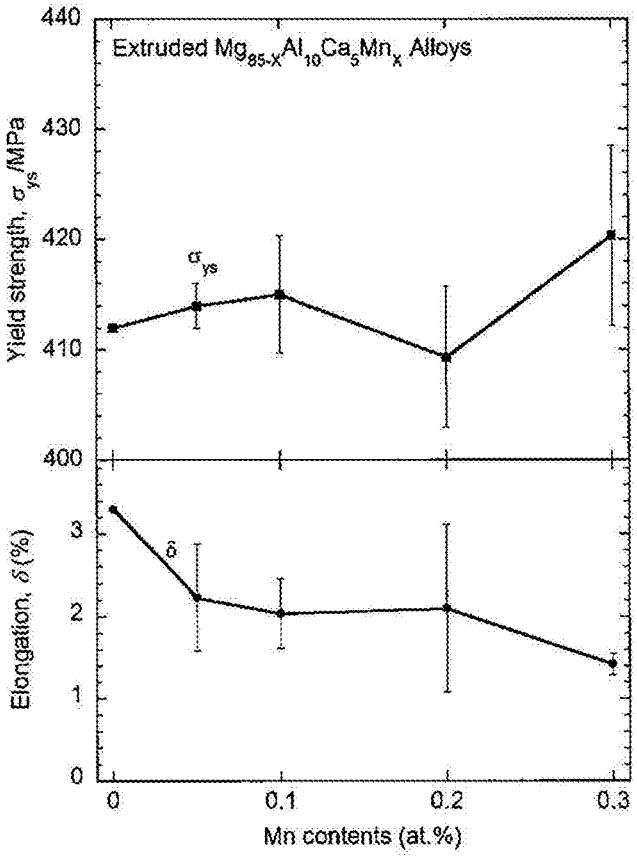
FIG. 22 is a diagram illustrating a relationship between the content of Mn, a yield strength and an elongation in the magnesium alloys of compositions shown in Table 7.

As illustrated in FIG. 22 and Table 7, it was confirmed that, when Mn was added to the Mg—Al—Ca alloy, the yield strength was not significantly changed but the maximum strength was able to be increased. However, the ductility was lowered.

(Corrosion Test)

A corrosion test 1 was performed on the magnesium alloys of compositions shown in Table 8. The conditions of the corrosion test 1 were that they were immersed in the 1 wt % NaCl neutral aqueous solution (initial pH=6.8) and that a corrosion rate was measured. The results thereof are shown in Table 8 and FIG. 23. The magnesium alloys of the compositions shown in Table 8 are the same as those shown in Table 7, and the method of producing the samples is also the same.

TABLE 8

| Composition | Corrosion rate [mm/year] |
|---|---|
| $Mg_{85}Al_{10}Ca_5$ | 2.85 |
| $Mg_{84.95}Al_{10}Ca_5Mn_{0.05}$ | 0.17 |
| $Mg_{84.9}Al_{10}Ca_5Mn_{0.1}$ | 0.2 |
| $Mg_{84.8}Al_{10}Ca_5Mn_{0.2}$ | 0.27 |
| $Mg_{84.7}Al_{10}Ca_5Mn_{0.3}$ | 0.39 |

Figure 23:
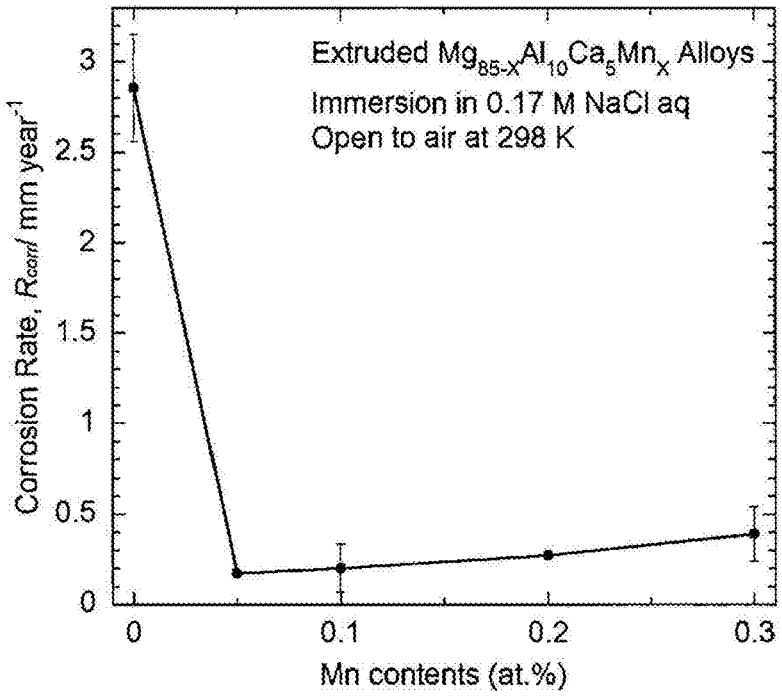
FIG. 23 is a diagram illustrating results when a corrosion test 1 was performed on the magnesium alloys of compositions shown in Table 8 and a relationship between the content of Mn and a corrosion rate.

According to FIG. 23 and Table 8, it was confirmed that the corrosion resistance was enhanced by the addition of Mn to the Mg—Al—Ca alloy.

Figure 24:
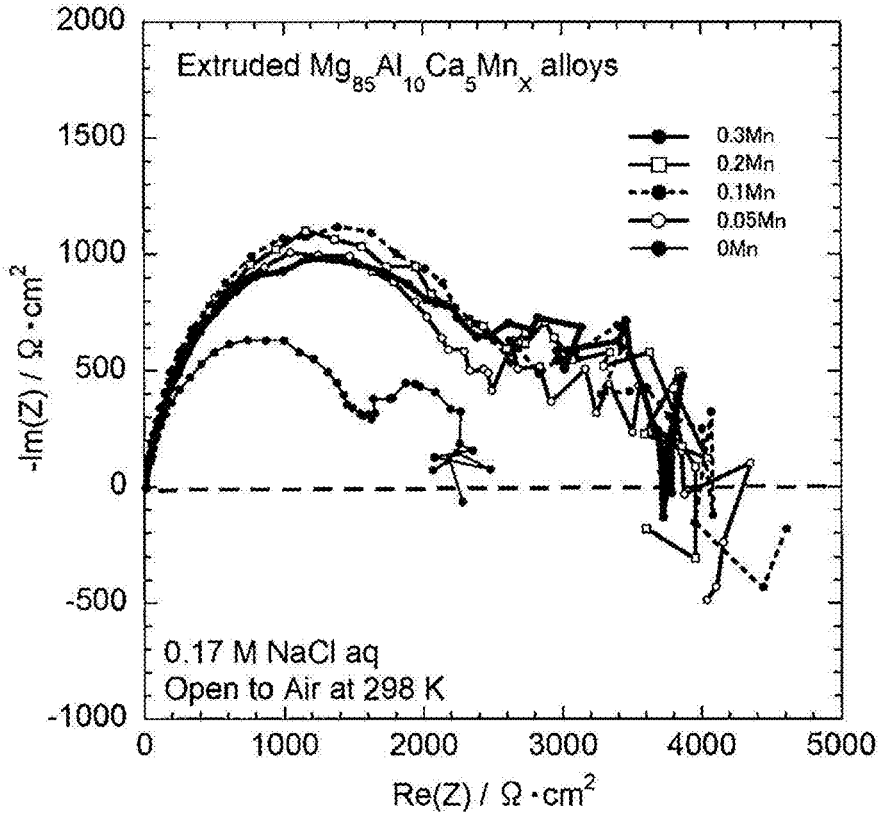
FIG. 24 is a diagram illustrating results when a corrosion test 2 was performed on the magnesium alloys of the compositions shown in Table 8 by an alternating-current impedance measurement.

FIG. 24 is a diagram illustrating results when a corrosion test 2 by an alternating-current impedance measurement was performed on the magnesium alloys of the compositions shown in Table 8. A method of performing the corrosion test 2 is as follows.

In a constant temperature bath of 298K, 400 ml of 1 wt % NaCl neutral aqueous solution (initial pH=6.8) was put into a beaker of 500 ml, the sample was immersed in this aqueous solution, and after the elapse of 5 minutes, the alternating-current impedance measurement was performed with an amplitude of 5 my and at a frequency of 10 mHz to 100 kHz.

It was confirmed from the result of the alternating-current impedance measurement illustrated in FIG. 24 that a corrosion film formed in the Mn-added alloy had a high impedance property.

Figure 25A:
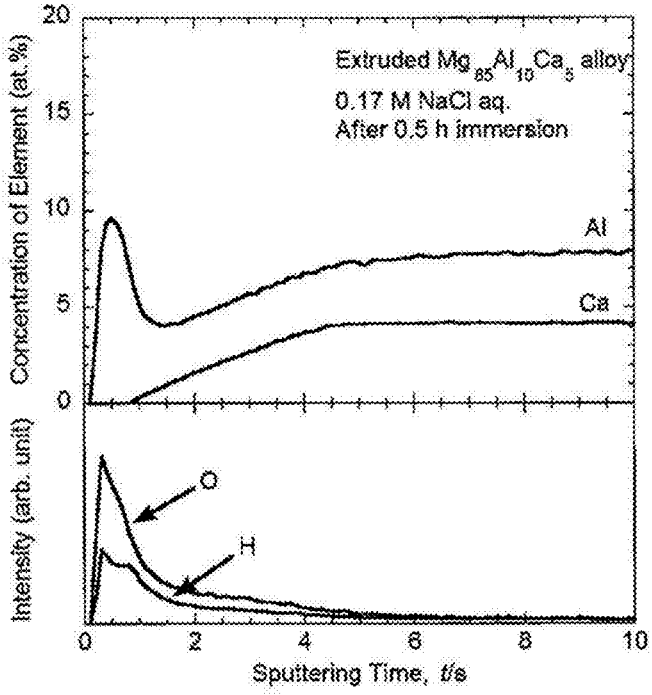
FIG. 25A is a diagram illustrating results when the chemical composition of a corrosion film was analyzed by glow discharge optical emission spectrometry after the corrosion test was performed on the $Mg_{85}Al_{10}Ca_5$ alloy.
Figure 25B:
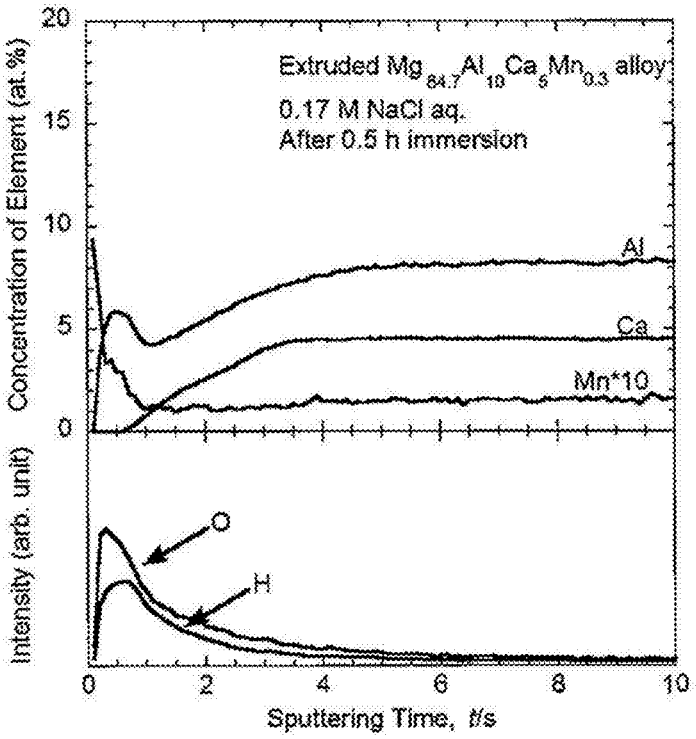
FIG. 25B is a diagram illustrating results when the chemical composition of a corrosion film was analyzed by glow discharge optical emission spectrometry after the corrosion test was performed on an $Mg_{84.7}Al_{10}Ca_5Mn_{0.3}$ alloy.

FIG. 25A is a diagram illustrating results when the chemical composition of the corrosion film was analyzed by glow discharge optical emission spectrometry after the $Mg_{85}Al_{10}Ca_5$ alloy was immersed in the 1 wt % NaCl neutral aqueous solution (initial pH=6.8) for 0.5 hours. FIG. 25B is a diagram illustrating results when the chemical composition of the corrosion film was analyzed by glow discharge optical emission spectrometry after an $Mg_{84.7}Al_{10}Ca_5Mn_{0.3}$ alloy was immersed in the 1 wt % NaCl neutral aqueous solution (initial pH=6.8) for 0.5 hours. The $Mg_{85}Al_{10}Ca_5$ alloy and the $Mg_{84.7}Al_{10}Ca_5Mn_{0.3}$ alloy are the same as those of the corresponding compositions shown in Table 7, and the method of producing the samples are also the same.

From FIGS. 25A and 25B, it was confirmed that the uppermost surface of the film of Mn was concentrated, and it was recognized that a film modification effect by the addition of Mn was achieved.

The invention claimed is:

1. A magnesium alloy that contains a atomic % of Ca and b atomic % of Al, totally contains k atomic % of at least one element selected from a group consisting of Zr, Ag, Y and Nd, contains a residue of Mg and contains c volume % of $(Mg, Al)_2Ca$, a, b, c and k satisfying formulae (1) to (4) and (21) below, wherein said $(Mg, Al)_2Ca$ is dispersed and said at least one element is an element that enhances at least one of corrosion resistance and flame resistance:

$$3 \le a \le 7 \quad (1)$$

$$4.5 \le b \le 12 \quad (2)$$

$$1.2 \le b/a \le 3.0 \quad (3)$$

$$10 \le c \le 30 \quad (4)$$

$$0 < k \le 0.3. \quad (21)$$

2. The magnesium alloy according to claim 1, wherein x atomic % of Zn is contained in said magnesium alloy, x satisfying formula (20) below:

$$0 < x \le 3 \quad (20)$$

3. The magnesium alloy according to claim 1, wherein said magnesium alloy contains d volume % of $Al_{12}Mg_{17}$, d satisfying formula (5) below:

$$0 < d \le 10. \quad (5)$$

4. The magnesium alloy according to claim 1, wherein a crystal grain diameter of said $(Mg, Al)_2Ca$ dispersed is e, e satisfying formula (6) below:

$$1\ \text{nm} \le e \le 2\ \mu\text{m}. \quad (6)$$

5. The magnesium alloy according to claim 1, wherein a volume fraction of a region where said $(Mg, Al)_2Ca$ is dispersed is f %, f satisfying formula (7) below:

$$35 \le f \le 65. \quad (7)$$

6. The magnesium alloy according to claim 1, wherein an ignition temperature of said magnesium alloy is equal to or more than 850° C.

7. The magnesium alloy according to claim 1, wherein said a and b satisfy formulae (1') and (2') below:

$$4 \leq a \leq 6.5 \quad (1')$$

$$7.5 \leq b \leq 11. \quad (2')$$

8. The magnesium alloy according to claim 7, wherein said a and b satisfy formula (3') below:

$$11/7 \leq b/a \leq 12/5. \quad (3')$$

9. The magnesium alloy according to claim 7, wherein the ignition temperature of said magnesium alloy is equal to or more than 1090° C.

10. The magnesium alloy according to claim 1, wherein when in said magnesium alloy, compression yield strength is g and tensile yield strength is h, g and h satisfy formula (8) below:

$$0.8 \leq g/h. \quad (8)$$

11. The magnesium alloy according to claim 1, wherein i atomic % of at least one element selected from a group consisting of rare earth elements other than Y and Nd, Si, Sc, Sn, Cu, Li, Be, Mo, Nb and W is contained in said magnesium alloy, i satisfying formula (9) below:

$$0 < i \leq 0.3. \quad (9)$$

12. The magnesium alloy according to claim 1, wherein j atomic % of at least one compound selected from a group consisting of $Al_2O_3$, $Mg_2Si$, SiC, MgO and CaO is contained in said magnesium alloy, as an amount of metal atoms in the compound, j satisfying formula (10) below:

$$0 < j \leq 5. \quad (10)$$

13. A magnesium alloy that contains a atomic % of Ca and b atomic % of Al, totally contains k atomic % of at least one element selected from a group consisting of Zr, Ag, Y and Nd, contains a residue of Mg and contains c volume % of $(Mg, Al)_2Ca$, a, b, c and k satisfying formulae (1) to (5) (4) and (21) below, wherein said $(Mg, Al)_2Ca$ is dispersed and said at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 30 \quad (4)$$

$$0 < k \leq 0.3. \quad (21)$$

14. A method of manufacturing a magnesium alloy, the method comprising the steps of:

forming, by a casting method, a cast that contains a atomic % of Ca and b atomic % of Al, totally contains k atomic % of at least one element selected from a group consisting of Zn, Zr, Ag, Y and Nd, has a composition in which a remaining part is formed of Mg, and contains c volume % of $(Mg, Al)_2Ca$, a, b and c satisfying formulae (1) to (4) and (21) below, and performing plastic processing on said cast, wherein said at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 30 \quad (4)$$

$$0 < k \leq 0.3. \quad (21)$$

15. The method of manufacturing a magnesium alloy according to claim 14, wherein said cast contains d volume % of $Al_{12}Mg_{17}$, d satisfying formula (5) below:

$$0 < d \leq 10. \quad (5)$$

16. The method of manufacturing a magnesium alloy according to claim 14, wherein a cooling rate when said cast is formed is equal to or less than 1000 K/second.

17. The method of manufacturing a magnesium alloy according to claim 14, wherein an equivalent strain when said plastic processing is performed is equal to or more than 2.2.

18. The method of manufacturing a magnesium alloy according to claim 14, wherein before said plastic processing, heat treatment is performed on said cast at a temperature of 400 to 600° C. for 5 minutes to 24 hours.

19. The method of manufacturing a magnesium alloy according to claim 14, wherein before said plastic processing, heat treatment is performed on said cast at a temperature of 723 to 773K for 0.5 hours or more.

20. The method of manufacturing a magnesium alloy according to claim 14, wherein said a and b satisfy formulae (1') and (2') below:

$$4 \leq a \leq 6.5 \quad (1')$$

$$7.5 \leq b \leq 11. \quad (2')$$

21. The method of manufacturing a magnesium alloy according to claim 20, wherein said a and b satisfy formula (3') below:

$$11/7 \leq b/a \leq 12/5. \quad (3')$$

22. The method of manufacturing a magnesium alloy according to claim 14, wherein a crystal grain diameter of said $(Mg, Al)_2Ca$ after said plastic processing is e, e satisfying formula (6) below:

$$1\ \text{nm} \leq e \leq 2\ \mu\text{m}. \quad (6)$$

23. The method of manufacturing a magnesium alloy according to claim 14, wherein a volume fraction of a region where said $(Mg, Al)_2Ca$ is dispersed after said plastic processing is f %, f satisfying formula (7) below:

$$35 \leq f \leq 65. \quad (7)$$

24. The method of manufacturing a magnesium alloy according to claim 14, wherein after said plastic processing, heat treatment is performed on said magnesium alloy.

25. The method of manufacturing a magnesium alloy according to claim 14, wherein after said plastic processing, solution treatment is performed on said magnesium alloy.

26. The method of manufacturing a magnesium alloy according to claim 25, wherein after said solution treatment, aging treatment is performed on said magnesium alloy.

27. The method of manufacturing a magnesium alloy according to claim 14, wherein when in said magnesium alloy, compression yield strength is g and tensile yield strength is h, g and h satisfy formula (8) below:

$$0.8 \leq g/h. \quad (8)$$

28. The method of manufacturing a magnesium alloy according to claim 14, wherein i atomic % of at least one element selected from a group consisting of rare earth elements other than Y and Nd, Si, Sc, Sn, Cu, Li, Be, Mo, Nb and W is contained in said cast, i satisfying formula (9) below:

$$0<i\leq 0.3. \quad (9)$$

29. The method of manufacturing a magnesium alloy according to claim 14, wherein j atomic % of at least one compound selected from a group consisting of $Al_2O_3$, $Mg_2Si$, SiC, MgO and CaO is contained in said cast as an amount of metal atoms in the compound, j satisfying formula (10) below:

$$0<j\leq 5. \quad (10)$$

30. A method of manufacturing a magnesium alloy, the method comprising the steps of:

forming, by a casting method, a cast that contains a atomic % of Ca and b atomic % of Al, totally contains k atomic % of at least one element selected from a group consisting of Zn, Zr, Ag, Y and Nd, contains a residue of Mg and contains c volume % of $(Mg, Al)_2Ca$, a, b and c satisfying formulae (1) to (4) and (21) below, and performing plastic processing on said cast, wherein said at least one element is an element that enhances at least one of corrosion resistance and flame resistance:

$$3\leq a\leq 7 \quad (1)$$

$$4.5\leq b\leq 12 \quad (2)$$

$$1.2\leq b/a\leq 3.0 \quad (3)$$

$$10\leq c\leq 30 \quad (4)$$

$$0<k\leq 0.3. \quad (21)$$

31. A method of manufacturing a magnesium alloy, the method comprising the steps of:

forming, by a casting method, a cast that contains a atomic % of Ca and b atomic % of Al, totally contains k atomic % of at least one element selected from a group consisting of Mn, Zr, Ag, Y and Nd, contains x atomic % of Zn, and contains a residue of Mg, a, b and c satisfying formulae (1) to (3), (20) and (21) below, and performing plastic processing on said cast, wherein said at least one element is an element that enhances at least one of corrosion resistance and flame resistance:

$$3\leq a\leq 7 \quad (1)$$

$$4.5\leq b\leq 12 \quad (2)$$

$$1.2\leq b/a\leq 3.0 \quad (3)$$

$$0<x\leq 3 \quad (20)$$

$$0<k\leq 0.3. \quad (21)$$

32. The method of manufacturing a magnesium alloy according to claim 31, wherein said cast contains c volume % of $(Mg, Al)_2Ca$ and c satisfies formula (4) below:

$$10\leq c\leq 30 \quad (4)$$

33. A method of manufacturing a magnesium alloy, the method comprising the steps of:

forming, by a casting method, a cast that contains a atomic % of Ca and b atomic % of Al, contains a residue of Mg, and contains c volume % of $(Mg, Al)_2Ca$, a, b, and c satisfying formulae (1) to (4) below, and performing heat treatment on said cast at a temperature of 723 to 773K for 0.5 hours or more, and performing plastic processing on said cast, $$3\leq a\leq 7 \quad (1)$$

$$4.5\leq b\leq 12 \quad (2)$$

$$1.2\leq b/a\leq 3.0 \quad (3)$$

$$10\leq c\leq 35 \quad (4)$$

34. A magnesium alloy that contains a atomic % of Ca and b atomic % of Al, totally contains k atomic % of Al, totally contains k atomic % of at least one element selected from a group consisting of Mn, Zr, Ag, Y and Nd, contains a residue of Mg and contains c volume % of $(Mg, Al)_2Ca$, a, b, c and k satisfying formulae (1) to (4) and (21) below, wherein x atomic % of Zn is contained in said magnesium alloy, x satisfying formula (20) below:

$$0<x\leq 3 \quad (20)$$

said $(Mg, Al)_2Ca$ is dispersed and said at least one element is an element that enhances at least one of corrosion resistance and flame resistance:

$$3\leq a\leq 7 \quad (1)$$

$$4.5\leq b\leq 12 \quad (2)$$

$$1.2\leq b/a\leq 3.0 \quad (3)$$

$$10\leq c\leq 30 \quad (4)$$

$$0<k\leq 0.3. \quad (21)$$

35. A magnesium alloy that contains a atomic % of Ca and b atomic % of Al, totally contains k atomic % of Al, totally contains k atomic % of at least one element selected from a group consisting of Mn, Zr, Ag, Y and Nd, contains a residue of Mg and contains c volume % of $(Mg, Al)_2Ca$, a, b, c and k satisfying formulae (1) to (4) and (21) below, wherein i atomic % of at least one element selected from a group consisting of rare earth elements other than Y and Nd, Sc, Cu, Li, Be, Mo, Nb and W is contained in said magnesium alloy, i satisfying formula (9) below:

$$0<i\leq 0.3. \quad (9)$$

said $(Mg, Al)_2Ca$ is dispersed and said at least one element is an element that enhances at least one of corrosion resistance and flame resistance:

$$3\leq a\leq 7 \quad (1)$$

$$4.5\leq b\leq 12 \quad (2)$$

$$1.2\leq b/a\leq 3.0 \quad (3)$$

$$10\leq c\leq 30 \quad (4)$$

$$0<k\leq 0.3. \quad (21)$$

36. A method of manufacturing a magnesium alloy, the method comprising the steps of:

forming, by a casting method, a cast that contains a atomic % of Ca and b atomic % of Al, totally contains k atomic % of at least one element selected from a group consisting of Mn, Zn, Zr, Ag, Y and Nd, has a composition in which a remaining part is formed of Mg, and contains c volume % of $(Mg, Al)_2Ca$, a, b and c satisfying formulae (1) to (4) and (21) below, and performing plastic processing on said cast, wherein said at least one element is an element that enhances at least one of corrosion resistance and flame resistance:

$$3 \leq a \leq 7 \quad (1)$$

$$4.5 \leq b \leq 12 \quad (2)$$

$$1.2 \leq b/a \leq 3.0 \quad (3)$$

$$10 \leq c \leq 30 \quad (4)$$

$$0 < k \leq 0.3. \quad (21)$$

wherein i atomic % of at least one element selected from a group consisting of rare earth elements other than Y and Nd, Si, Sc, Sn, Cu, Li, Be, Mo, Nb and W is contained in said cast, i satisfying formula (9) below:

$$0 < i \leq 0.3. \quad (9)$$

* * * * *